US008994617B2

(12) United States Patent
Chaji et al.

(10) Patent No.: US 8,994,617 B2
(45) Date of Patent: Mar. 31, 2015

(54) LIFETIME UNIFORMITY PARAMETER EXTRACTION METHODS

(75) Inventors: Gholamreza Chaji, Waterloo (CA); Javid Jaffari, Kitchener (CA); Arokia Nathan, Cambridge (CA)

(73) Assignee: Ignis Innovation Inc., Waterloo, Ontario (CA)

( * ) Notice: Subject to any disclaimer, the term of this patent is extended or adjusted under 35 U.S.C. 154(b) by 567 days.

(21) Appl. No.: 13/050,006

(22) Filed: Mar. 17, 2011

(65) Prior Publication Data

US 2011/0227964 A1 Sep. 22, 2011

(30) Foreign Application Priority Data

Mar. 17, 2010 (CA) ..... 2696778

(51) Int. Cl.
*G09G 3/30* (2006.01)
*G09G 3/00* (2006.01)
*G09G 3/32* (2006.01)

(52) U.S. Cl.
CPC ..... *G09G 3/006* (2013.01); *G09G 3/3225* (2013.01); *G09G 2320/0233* (2013.01); *G09G 2320/0285* (2013.01); *G09G 2320/029* (2013.01);
(Continued)

(58) Field of Classification Search
CPC ..... G09G 3/006; G09G 3/3225; G09G 2320/043; G09G 2320/0233; G09G 3/30–3/3291
USPC ..... 702/106–126; 348/175–191; 345/76
See application file for complete search history.

(56) References Cited

U.S. PATENT DOCUMENTS 3,506,851 A 4/1970 Polkinghorn et al.
3,750,987 A 8/1973 Gobel
(Continued)

FOREIGN PATENT DOCUMENTS

AU 729652 6/1997
AU 764896 12/2001
(Continued)

OTHER PUBLICATIONS

Lindsay I. Smith, "A tutorial on Principal Component Analysis," Feb. 26, 2002, pp. 21-22.*
(Continued)

*Primary Examiner* — Alexander Eisen
*Assistant Examiner* — Sanjiv D Patel
(74) *Attorney, Agent, or Firm* — Nixon Peabody LLP

(57) ABSTRACT

A system and method for deriving a sequence of OLED non-uniformity test patterns. A pattern generator generates a full sequence of display patterns according to a transform function, such as a discrete cosine transformation or wavelet transformation. A driver drives a display with each of the sequence of patterns. A sensor senses a property of the display, such as a total current for the display, for each of the sequence of patterns. An extraction unit derives a pixel non-uniformity model using the sensed properties and an inverse of the transform function. Patterns that contribute less than a threshold amount to the non-uniformity model can be identified and deleted to derive a sparse sequence of patterns, which can be stored in a memory. The sparse sequence of patterns can be used to test the display and extract a set of pixel non-uniformity values. The pixel non-uniformity values can be used to generate a correction signal for the display.

20 Claims, 11 Drawing Sheets

(52) U.S. Cl.
CPC .... *G09G2320/043* (2013.01); *G09G 2320/045* (2013.01); *G09G 2330/12* (2013.01); *G09G 2360/14* (2013.01)
USPC ..... 345/76; 345/77; 345/690; 345/694

(56) References Cited

U.S. PATENT DOCUMENTS 3,774,055 A 11/1973 Bapat et al.
4,090,096 A 5/1978 Nagami
4,160,934 A 7/1979 Kirsch
4,354,162 A 10/1982 Wright
4,943,956 A 7/1990 Noro
4,996,523 A 2/1991 Bell et al.
5,134,387 A 7/1992 Smith et al.
5,153,420 A 10/1992 Hack et al.
5,170,158 A 12/1992 Shinya
5,198,803 A 3/1993 Shie et al.
5,204,661 A 4/1993 Hack et al.
5,266,515 A 11/1993 Robb et al.
5,278,542 A 1/1994 Smith et al.
5,408,267 A 4/1995 Main
5,489,918 A 2/1996 Mosier
5,498,880 A 3/1996 Lee et al.
5,557,342 A 9/1996 Eto et al.
5,572,444 A * 11/1996 Lentz et al. ..... 702/117
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,723,950 A 3/1998 Wei et al.
5,744,824 A 4/1998 Kousai et al.
5,745,660 A * 4/1998 Kolpatzik et al. ..... 358/3.19
5,748,160 A 5/1998 Shieh et al.
5,758,129 A 5/1998 Gray et al.
5,815,303 A 9/1998 Berlin
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,945,972 A 8/1999 Okumura et al.
5,949,398 A 9/1999 Kim
5,952,789 A 9/1999 Stewart et al.
5,952,991 A 9/1999 Akiyama et al.
5,982,104 A 11/1999 Sasaki et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,177,915 B1 1/2001 Beeteson et al.
6,229,506 B1 5/2001 Dawson et al.
6,229,508 B1 5/2001 Kane
6,246,180 B1 6/2001 Nishigaki
6,252,248 B1 6/2001 Sano et al.
6,259,424 B1 7/2001 Kurogane
6,262,589 B1 7/2001 Tamukai
6,268,841 B1 7/2001 Cairns et al.
6,271,825 B1 8/2001 Greene et al.
6,288,696 B1 9/2001 Holloman
6,304,039 B1 10/2001 Appelberg et al.
6,307,322 B1 10/2001 Dawson et al.
6,310,962 B1 * 10/2001 Chung et al. ..... 382/100
6,320,325 B1 11/2001 Cok et al.
6,323,631 B1 11/2001 Juang
6,333,729 B1 12/2001 Ha
6,356,029 B1 3/2002 Hunter
6,373,454 B1 4/2002 Knapp et al.
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,437,106 B1 8/2002 Stoner et al.
6,445,369 B1 9/2002 Yang et al.
6,473,065 B1 10/2002 Fan
6,475,845 B2 11/2002 Kimura
6,501,098 B2 12/2002 Yamazaki
6,501,466 B1 12/2002 Yamagishi et al.
6,518,962 B2 2/2003 Kimura et al.
6,522,315 B2 2/2003 Ozawa et al.
6,525,683 B1 2/2003 Gu
6,531,827 B2 3/2003 Kawashima
6,535,185 B2 3/2003 Kim et al.
6,542,138 B1 4/2003 Shannon et al.
6,555,420 B1 4/2003 Yamazaki
6,559,839 B1 5/2003 Ueno et al.
6,580,408 B1 6/2003 Bae et al.
6,580,657 B2 6/2003 Sanford et al.
6,583,398 B2 6/2003 Harkin
6,583,775 B1 6/2003 Sekiya et al.
6,594,606 B2 7/2003 Everitt
6,618,030 B2 9/2003 Kane et al.
6,639,244 B1 10/2003 Yamazaki et al.
6,668,645 B1 12/2003 Gilmour et al.
6,677,713 B1 1/2004 Sung
6,680,580 B1 1/2004 Sung
6,686,699 B2 2/2004 Yumoto
6,687,266 B1 2/2004 Ma et al.
6,690,000 B1 2/2004 Muramatsu et al.
6,690,344 B1 2/2004 Takeuchi et al.
6,693,388 B2 2/2004 Oomura
6,693,610 B2 2/2004 Shannon et al.
6,694,248 B2 2/2004 Smith et al.
6,697,057 B2 2/2004 Koyama et al.
6,720,942 B2 4/2004 Lee et al.
6,724,151 B2 4/2004 Yoo
6,734,636 B2 5/2004 Sanford et al.
6,738,034 B2 5/2004 Kaneko et al.
6,738,035 B1 5/2004 Fan
6,753,655 B2 6/2004 Shih et al.
6,753,834 B2 6/2004 Mikami et al.
6,756,741 B2 6/2004 Li
6,756,952 B1 6/2004 Decaux et al.
6,756,958 B2 6/2004 Furuhashi et al.
6,771,028 B1 8/2004 Winters
6,777,712 B2 8/2004 Sanford et al.
6,777,888 B2 8/2004 Kondo
6,781,567 B2 8/2004 Kimura
6,788,231 B1 9/2004 Hsueh
6,806,497 B2 10/2004 Jo
6,806,638 B2 10/2004 Lin et al.
6,806,857 B2 10/2004 Sempel et al.
6,809,706 B2 10/2004 Shimoda
6,815,975 B2 11/2004 Nara et al.
6,828,950 B2 12/2004 Koyama
6,853,371 B2 2/2005 Miyajima et al.
6,858,991 B2 2/2005 Miyazawa
6,859,193 B1 2/2005 Yumoto
6,873,117 B2 3/2005 Ishizuka
6,876,346 B2 4/2005 Anzai et al.
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky et al.
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura et al.
6,940,214 B1 9/2005 Komiya et al.
6,943,500 B2 9/2005 LeChevalier

(56) References Cited

U.S. PATENT DOCUMENTS 6,947,022 B2 9/2005 McCartney
6,954,194 B2 10/2005 Matsumoto et al.
6,956,547 B2 10/2005 Bae et al.
6,970,149 B2 11/2005 Chung et al.
6,975,142 B2 12/2005 Azami et al.
6,975,332 B2 * 12/2005 Arnold et al. ..... 345/611
6,995,510 B2 2/2006 Murakami et al.
6,995,519 B2 * 2/2006 Arnold et al. ..... 315/169.3
7,023,408 B2 4/2006 Chen et al.
7,027,015 B2 4/2006 Booth, Jr. et al.
7,027,078 B2 4/2006 Reihl
7,034,793 B2 4/2006 Sekiya et al.
7,038,392 B2 5/2006 Libsch et al.
7,057,359 B2 6/2006 Hung et al.
7,057,588 B2 6/2006 Asano et al.
7,061,451 B2 6/2006 Kimura
7,064,733 B2 6/2006 Cok et al.
7,071,932 B2 7/2006 Libsch et al.
7,088,051 B1 8/2006 Cok
7,088,052 B2 8/2006 Kimura
7,102,378 B2 9/2006 Kuo et al.
7,106,285 B2 9/2006 Naugler
7,112,820 B2 9/2006 Change et al.
7,113,864 B2 9/2006 Smith et al.
7,116,058 B2 10/2006 Lo et al.
7,119,493 B2 10/2006 Fryer et al.
7,122,835 B1 10/2006 Ikeda et al.
7,127,380 B1 10/2006 Iverson et al.
7,129,914 B2 10/2006 Knapp et al.
7,164,417 B2 * 1/2007 Cok ..... 345/207
7,193,589 B2 3/2007 Yoshida et al.
7,224,332 B2 * 5/2007 Cok ..... 345/76
7,227,519 B1 6/2007 Kawase et al.
7,245,277 B2 7/2007 Ishizuka
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,339,560 B2 3/2008 Sun
7,343,243 B2 3/2008 Smith et al.
7,355,574 B1 4/2008 Leon et al.
7,358,941 B2 4/2008 Ono et al.
7,368,868 B2 5/2008 Sakamoto
7,411,571 B2 8/2008 Huh
7,414,600 B2 8/2008 Nathan et al.
7,423,617 B2 9/2008 Giraldo et al.
7,466,166 B2 12/2008 Date et al.
7,474,285 B2 1/2009 Kimura
7,495,501 B2 2/2009 Iwabuchi et al.
7,502,000 B2 3/2009 Yuki et al.
7,515,124 B2 4/2009 Yaguma et al.
7,528,812 B2 5/2009 Tsuge et al.
7,535,449 B2 5/2009 Miyazawa
7,554,512 B2 6/2009 Steer
7,569,849 B2 8/2009 Nathan et al.
7,576,718 B2 8/2009 Miyazawa
7,580,012 B2 8/2009 Kim et al.
7,589,707 B2 9/2009 Chou
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,633,470 B2 12/2009 Kane
7,639,211 B2 12/2009 Miyazawa
7,656,370 B2 2/2010 Schneider et al.
7,683,899 B2 3/2010 Hirakata et al.
7,688,289 B2 3/2010 Abe et al.
7,760,162 B2 7/2010 Miyazawa
7,800,558 B2 9/2010 Routley et al.
7,808,008 B2 10/2010 Miyake
7,847,764 B2 12/2010 Cok et al.
7,859,492 B2 12/2010 Kohno
7,859,520 B2 12/2010 Kimura
7,868,859 B2 1/2011 Tomida et al.
7,876,294 B2 1/2011 Sasaki et al.
7,889,159 B2 2/2011 Nathan et al.
7,903,127 B2 3/2011 Kwon
7,920,116 B2 4/2011 Woo et al.
7,924,249 B2 4/2011 Nathan et al.
7,932,883 B2 4/2011 Klompenhouwer et al.
7,944,414 B2 5/2011 Shirasaki et al.
7,969,390 B2 6/2011 Yoshida
7,978,170 B2 7/2011 Park et al.
7,978,187 B2 7/2011 Nathan et al.
7,989,392 B2 8/2011 Crockett et al.
7,994,712 B2 8/2011 Sung et al.
7,995,008 B2 8/2011 Miwa
8,026,876 B2 9/2011 Nathan et al.
8,049,420 B2 11/2011 Tamura et al.
8,063,852 B2 11/2011 Kwak et al.
8,077,123 B2 12/2011 Naugler, Jr.
8,102,343 B2 1/2012 Yatabe
8,115,707 B2 2/2012 Nathan et al.
8,144,081 B2 3/2012 Miyazawa
8,159,007 B2 4/2012 Bama et al.
8,208,084 B2 6/2012 Lin
8,223,177 B2 7/2012 Nathan et al.
8,232,939 B2 7/2012 Nathan et al.
8,242,979 B2 8/2012 Anzai et al.
8,253,665 B2 8/2012 Nathan et al.
8,259,044 B2 9/2012 Nathan et al.
8,264,431 B2 9/2012 Bulovic et al.
8,279,143 B2 10/2012 Nathan et al.
8,319,712 B2 11/2012 Nathan et al.
8,339,386 B2 12/2012 Leon et al.
2001/0002703 A1 6/2001 Koyama
2001/0009283 A1 7/2001 Arao et al.
2001/0024181 A1 9/2001 Kubota
2001/0024186 A1 9/2001 Kane et al.
2001/0026257 A1 10/2001 Kimura
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052606 A1 12/2001 Sempel et al.
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai et al.
2002/0018034 A1 2/2002 Ohki et al.
2002/0030190 A1 3/2002 Ohtani et al.
2002/0047565 A1 * 4/2002 Nara et al. ..... 315/169.3
2002/0052086 A1 5/2002 Maeda
2002/0067134 A1 6/2002 Kawashima
2002/0080108 A1 6/2002 Wang
2002/0084463 A1 7/2002 Sanford et al.
2002/0101172 A1 8/2002 Bu
2002/0105279 A1 8/2002 Kimura
2002/0117722 A1 8/2002 Osada et al.
2002/0122308 A1 9/2002 Ikeda
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0167474 A1 11/2002 Everitt
2002/0171613 A1 11/2002 Goto et al.
2002/0180369 A1 12/2002 Koyama
2002/0180721 A1 12/2002 Kimura et al.
2002/0181276 A1 12/2002 Yamazaki
2002/0186214 A1 12/2002 Siwinski
2002/0190924 A1 12/2002 Asano et al.
2002/0190971 A1 12/2002 Nakamura et al.
2002/0195967 A1 12/2002 Kim et al.

(56) References Cited

U.S. PATENT DOCUMENTS

2002/0195968 A1 12/2002 Sanford et al.
2003/0001828 A1 1/2003 Asano
2003/0020413 A1 1/2003 Oomura
2003/0030603 A1 2/2003 Shimoda
2003/0043088 A1 3/2003 Booth et al.
2003/0057895 A1 3/2003 Kimura
2003/0058226 A1 3/2003 Bertram et al.
2003/0062524 A1 4/2003 Kimura
2003/0062844 A1 4/2003 Miyazawa
2003/0063081 A1 4/2003 Kimura et al.
2003/0071821 A1 4/2003 Sundahl et al.
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122745 A1 7/2003 Miyazawa
2003/0122747 A1 7/2003 Shannon et al.
2003/0122813 A1 7/2003 Ishizuki et al.
2003/0128199 A1 7/2003 Kimura
2003/0142088 A1 7/2003 LeChevalier
2003/0151569 A1 8/2003 Lee et al.
2003/0156101 A1 8/2003 Le Chevalier
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1* 10/2003 Osawa et al. ..... 382/162
2003/0189535 A1 10/2003 Matsumoto et al.
2003/0197663 A1 10/2003 Lee et al.
2003/0210256 A1 11/2003 Mori et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2003/0231148 A1 12/2003 Lin et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070565 A1 4/2004 Nayar et al.
2004/0090186 A1 5/2004 Kanauchi et al.
2004/0090400 A1 5/2004 Yoo
2004/0095297 A1 5/2004 Libsch et al.
2004/0100427 A1 5/2004 Miyazawa
2004/0108518 A1 6/2004 Jo
2004/0129933 A1 7/2004 Nathan et al.
2004/0135749 A1 7/2004 Kondakov et al.
2004/0140982 A1 7/2004 Pate
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0160516 A1 8/2004 Ford
2004/0171619 A1 9/2004 Libsch et al.
2004/0174347 A1 9/2004 Sun et al.
2004/0174349 A1 9/2004 Libsch
2004/0174354 A1 9/2004 Ono et al.
2004/0178743 A1 9/2004 Miller et al.
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239596 A1 12/2004 Ono et al.
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257313 A1 12/2004 Kawashima et al.
2004/0257353 A1 12/2004 Imamura et al.
2004/0257355 A1 12/2004 Naugler
2004/0263437 A1 12/2004 Hattori
2004/0263444 A1 12/2004 Kimura
2004/0263445 A1 12/2004 Inukai et al.
2004/0263541 A1 12/2004 Takeuchi et al.
2005/0007355 A1 1/2005 Miura
2005/0007357 A1 1/2005 Yamashita et al.
2005/0007392 A1 1/2005 Kasai et al.
2005/0017650 A1 1/2005 Fryer et al.
2005/0024081 A1 2/2005 Kuo et al.
2005/0024393 A1 2/2005 Kondo et al.
2005/0030267 A1 2/2005 Tanghe et al.
2005/0052379 A1 3/2005 Waterman
2005/0057459 A1 3/2005 Miyazawa
2005/0057484 A1 3/2005 Diefenbaugh et al.
2005/0057580 A1 3/2005 Yamano et al.
2005/0067970 A1 3/2005 Libsch et al.
2005/0067971 A1 3/2005 Kane
2005/0068270 A1 3/2005 Awakura
2005/0068275 A1 3/2005 Kane
2005/0073264 A1 4/2005 Matsumoto
2005/0083270 A1 4/2005 Miyazawa
2005/0083323 A1 4/2005 Suzuki et al.
2005/0088103 A1 4/2005 Kageyama et al.
2005/0110420 A1* 5/2005 Arnold et al. ..... 315/169.3
2005/0110727 A1 5/2005 Shin
2005/0110807 A1 5/2005 Chang
2005/0123193 A1 6/2005 Lamberg et al.
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0162079 A1 7/2005 Sakamoto
2005/0168416 A1 8/2005 Hashimoto et al.
2005/0179626 A1 8/2005 Yuki et al.
2005/0179628 A1 8/2005 Kimura
2005/0185200 A1 8/2005 Tobol
2005/0200575 A1 9/2005 Kim et al.
2005/0206590 A1 9/2005 Sasaki et al.
2005/0212787 A1 9/2005 Noguchi et al.
2005/0219184 A1 10/2005 Zehner et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0269959 A1 12/2005 Uchino et al.
2005/0269960 A1 12/2005 Ono et al.
2005/0280615 A1 12/2005 Cok et al.
2005/0280766 A1 12/2005 Johnson et al.
2005/0285822 A1 12/2005 Reddy et al.
2005/0285825 A1 12/2005 Eom et al.
2006/0001613 A1 1/2006 Routley et al.
2006/0007072 A1 1/2006 Choi et al.
2006/0007249 A1 1/2006 Reddy et al.
2006/0012310 A1 1/2006 Chen et al.
2006/0012311 A1 1/2006 Ogawa
2006/0022305 A1 2/2006 Yamashita
2006/0027807 A1 2/2006 Nathan et al.
2006/0030084 A1 2/2006 Young
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0077135 A1 4/2006 Cok et al.
2006/0077142 A1 4/2006 Kwon
2006/0082523 A1 4/2006 Guo et al.
2006/0092185 A1 5/2006 Jo et al.
2006/0097628 A1 5/2006 Suh et al.
2006/0097631 A1 5/2006 Lee
2006/0103611 A1 5/2006 Choi
2006/0125408 A1 6/2006 Nathan et al.

(56) References Cited

U.S. PATENT DOCUMENTS

2006/0139253 A1 6/2006 Choi et al.
2006/0145964 A1 7/2006 Park et al.
2006/0149493 A1 7/2006 Sambandan et al.
2006/0170623 A1 8/2006 Naugler, Jr. et al.
2006/0176250 A1 8/2006 Nathan et al.
2006/0191178 A1 8/2006 Sempel et al.
2006/0208961 A1 9/2006 Nathan et al.
2006/0208971 A1 9/2006 Deane
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0273997 A1 12/2006 Nathan et al.
2006/0279481 A1 12/2006 Haruna et al.
2006/0284801 A1 12/2006 Yoon et al.
2006/0284895 A1 12/2006 Marcu et al.
2006/0290614 A1 12/2006 Nathan et al.
2006/0290618 A1 12/2006 Goto
2007/0001937 A1 1/2007 Park et al.
2007/0001939 A1 1/2007 Hashimoto et al.
2007/0001945 A1 1/2007 Yoshida et al.
2007/0008251 A1 1/2007 Kohno et al.
2007/0008268 A1 1/2007 Park et al.
2007/0008297 A1 1/2007 Bassetti
2007/0035489 A1 2/2007 Lee
2007/0035707 A1 2/2007 Margulis
2007/0040773 A1 2/2007 Lee et al.
2007/0040782 A1 2/2007 Woo et al.
2007/0057873 A1 3/2007 Uchino et al.
2007/0057874 A1 3/2007 Le Roy et al.
2007/0063932 A1 3/2007 Nathan et al.
2007/0069998 A1 3/2007 Naugler et al.
2007/0075727 A1 4/2007 Nakano et al.
2007/0076226 A1 4/2007 Klompenhouwer et al.
2007/0080905 A1 4/2007 Takahara
2007/0080906 A1 4/2007 Tanabe
2007/0080908 A1 4/2007 Nathan et al.
2007/0085801 A1 4/2007 Park et al.
2007/0097038 A1 5/2007 Yamazaki et al.
2007/0097041 A1 5/2007 Park et al.
2007/0103419 A1 5/2007 Uchino et al.
2007/0109232 A1 5/2007 Yamamoto et al.
2007/0115221 A1 5/2007 Buchhauser et al.
2007/0128583 A1 6/2007 Miyazawa
2007/0164664 A1 7/2007 Ludwicki et al.
2007/0164941 A1 7/2007 Park et al.
2007/0182671 A1 8/2007 Nathan et al.
2007/0236430 A1 10/2007 Fish
2007/0236440 A1 10/2007 Wacyk et al.
2007/0236517 A1 10/2007 Kimpe
2007/0241999 A1 10/2007 Lin
2007/0242008 A1 10/2007 Cummings
2007/0273294 A1 11/2007 Nagayama
2007/0285359 A1 12/2007 Ono
2007/0290958 A1 12/2007 Cok
2007/0296672 A1 12/2007 Kim et al.
2008/0001525 A1 1/2008 Chao et al.
2008/0001544 A1 1/2008 Murakami et al.
2008/0030518 A1 2/2008 Higgins et al.
2008/0036708 A1 2/2008 Shirasaki
2008/0042942 A1 2/2008 Takahashi
2008/0042948 A1 2/2008 Yamashita et al.
2008/0043044 A1 2/2008 Woo et al.
2008/0048951 A1* 2/2008 Naugler et al. ..... 345/82
2008/0055134 A1 3/2008 Li et al.
2008/0055209 A1 3/2008 Cok
2008/0055211 A1 3/2008 Ogawa
2008/0074360 A1 3/2008 Lu et al.
2008/0074413 A1 3/2008 Ogura
2008/0088549 A1 4/2008 Nathan et al.
2008/0088648 A1 4/2008 Nathan et al.
2008/0094426 A1 4/2008 Kimpe
2008/0111766 A1 5/2008 Uchino et al.
2008/0116787 A1 5/2008 Hsu et al.
2008/0117144 A1 5/2008 Nakano et al.
2008/0122819 A1 5/2008 Cho et al.
2008/0129906 A1 6/2008 Lin et al.
2008/0150845 A1 6/2008 Ishii et al.
2008/0150847 A1 6/2008 Kim et al.
2008/0158115 A1 7/2008 Cordes et al.
2008/0158648 A1 7/2008 Cummings
2008/0198103 A1 8/2008 Toyomura et al.
2008/0211749 A1 9/2008 Weitbruch et al.
2008/0228562 A1 9/2008 Smith et al.
2008/0231558 A1 9/2008 Naugler
2008/0231562 A1 9/2008 Kwon
2008/0231625 A1 9/2008 Minami et al.
2008/0231641 A1 9/2008 Miyashita
2008/0252223 A1 10/2008 Toyoda et al.
2008/0252571 A1 10/2008 Hente et al.
2008/0259020 A1 10/2008 Fisekovic et al.
2008/0265786 A1 10/2008 Koyama
2008/0290805 A1 11/2008 Yamada et al.
2008/0297055 A1 12/2008 Miyake et al.
2009/0009459 A1 1/2009 Miyashita
2009/0015532 A1 1/2009 Katayama et al.
2009/0058772 A1 3/2009 Lee
2009/0058789 A1 3/2009 Hung et al.
2009/0109142 A1 4/2009 Takahara
2009/0121988 A1 5/2009 Amo et al.
2009/0121994 A1 5/2009 Miyata
2009/0146926 A1 6/2009 Sung et al.
2009/0153448 A1 6/2009 Tomida et al.
2009/0153459 A9 6/2009 Han et al.
2009/0160743 A1 6/2009 Tomida et al.
2009/0174628 A1* 7/2009 Wang et al. ..... 345/76
2009/0184901 A1 7/2009 Kwon
2009/0195483 A1 8/2009 Naugler, Jr. et al.
2009/0201230 A1 8/2009 Smith
2009/0201281 A1 8/2009 Routley et al.
2009/0206764 A1 8/2009 Schemmann et al.
2009/0213046 A1 8/2009 Nam
2009/0244046 A1 10/2009 Seto
2009/0251486 A1 10/2009 Sakakibara et al.
2009/0278777 A1 11/2009 Wang et al.
2009/0289964 A1 11/2009 Miyachi
2010/0004891 A1 1/2010 Ahlers et al.
2001/0026725 A1 2/2010 Smith
2010/0039422 A1 2/2010 Seto
2010/0039451 A1 2/2010 Jung
2010/0039453 A1 2/2010 Nathan et al.
2010/0039458 A1 2/2010 Nathan et al.
2010/0060911 A1 3/2010 Marcu et al.
2010/0079419 A1 4/2010 Shibusawa
2010/0165002 A1 7/2010 Ahn
2010/0194670 A1 8/2010 Cok
2010/0207920 A1 8/2010 Chaji et al.
2010/0207960 A1 8/2010 Kimpe et al.
2010/0225630 A1 9/2010 Levey et al.
2010/0225634 A1 9/2010 Levey et al.
2010/0251295 A1 9/2010 Amento et al.
2010/0269889 A1 10/2010 Reinhold et al.
2010/0277400 A1 11/2010 Jeong
2010/0315319 A1 12/2010 Cok et al.
2011/0050741 A1 3/2011 Jeong
2011/0063197 A1 3/2011 Chung et al.
2011/0069051 A1 3/2011 Nakamura et al.
2011/0069089 A1 3/2011 Kopf et al.
2011/0074750 A1 3/2011 Leon et al.
2011/0149166 A1 6/2011 Botzas et al.
2011/0199395 A1 8/2011 Nathan et al.
2011/0227964 A1 9/2011 Chaji et al.
2011/0273399 A1 11/2011 Lee
2011/0293480 A1 12/2011 Mueller
2012/0056558 A1 3/2012 Toshiya et al.
2012/0062565 A1 3/2012 Fuchs et al.
2012/0262184 A1 10/2012 Shen
2012/0299978 A1 11/2012 Chaji
2013/0027381 A1 1/2013 Nathan et al.
2013/0057595 A1 3/2013 Nathan et al.

(56) References Cited

U.S. PATENT DOCUMENTS

| | | | |
|---|---|---|---|
| 2013/0112960 | A1 | 5/2013 | Chaji et al. |
| 2013/0135272 | A1 | 5/2013 | Park |
| 2013/0309821 | A1 | 11/2013 | Yoo et al. |
| 2013/0321671 | A1 | 12/2013 | Cote et al. |

FOREIGN PATENT DOCUMENTS

| | | | |
|---|---|---|---|
| CA | 1294034 | | 1/1992 |
| CA | 2109951 | | 11/1992 |
| CA | 2249592 | | 7/1998 |
| CA | 2303302 | | 3/1999 |
| CA | 2368386 | | 9/1999 |
| CA | 2242720 | | 1/2000 |
| CA | 2354018 | | 6/2000 |
| CA | 2432530 | | 7/2002 |
| CA | 2436451 | | 8/2002 |
| CA | 2438577 | | 8/2002 |
| CA | 2507276 | | 8/2002 |
| CA | 2463653 | | 1/2004 |
| CA | 2498136 | | 3/2004 |
| CA | 2522396 | | 11/2004 |
| CA | 2438363 | | 2/2005 |
| CA | 2443206 | | 3/2005 |
| CA | 2519097 | | 3/2005 |
| CA | 2472671 | | 12/2005 |
| CA | 2523841 | | 1/2006 |
| CA | 2567076 | | 1/2006 |
| CA | 2526782 | | 4/2006 |
| CA | 2495726 | | 7/2006 |
| CA | 2557713 | | 11/2006 |
| CA | 2651893 | | 11/2007 |
| CA | 2550102 | | 4/2008 |
| CA | 2672590 | | 10/2009 |
| CA | 2773699 | | 10/2013 |
| CN | 1381032 | | 11/2002 |
| CN | 1448908 | | 10/2003 |
| CN | 1601594 | A | 3/2005 |
| CN | 1760945 | | 4/2006 |
| CN | 1886774 | | 12/2006 |
| CN | 102656621 | | 9/2012 |
| DE | 202006007613 | | 9/2006 |
| EP | 0158366 | | 10/1985 |
| EP | 0478186 | | 4/1992 |
| EP | 1028471 | | 8/2000 |
| EP | 1111577 | | 6/2001 |
| EP | 1130565 | A1 | 9/2001 |
| EP | 1 194 013 | | 3/2002 |
| EP | 1321922 | | 6/2003 |
| EP | 1 335 430 | A1 | 8/2003 |
| EP | 1372136 | | 12/2003 |
| EP | 1 381 019 | | 1/2004 |
| EP | 1418566 | | 5/2004 |
| EP | 1429312 | A | 6/2004 |
| EP | 1439520 | A2 | 7/2004 |
| EP | 1450341 | A | 8/2004 |
| EP | 1465143 | A | 10/2004 |
| EP | 1469448 | A | 10/2004 |
| EP | 1473689 | A | 11/2004 |
| EP | 1517290 | A2 | 3/2005 |
| EP | 1 521 203 | A2 | 4/2005 |
| EP | 1594347 | | 11/2005 |
| EP | 1784055 | A2 | 5/2007 |
| EP | 1854338 | A1 | 11/2007 |
| EP | 1879169 | A1 | 1/2008 |
| EP | 1879172 | | 1/2008 |
| GB | 2 389 951 | | 12/2003 |
| GB | 2 399 935 | | 9/2004 |
| GB | 2 460 018 | | 11/2009 |
| JP | 1272298 | | 10/1989 |
| JP | 4042619 | | 2/1992 |
| JP | 6314977 | | 11/1994 |
| JP | 8340243 | | 12/1996 |
| JP | 09090405 | | 4/1997 |
| JP | 10-254410 | | 9/1998 |
| JP | 11202295 | | 7/1999 |
| JP | 11219146 | | 8/1999 |
| JP | 11231805 | | 8/1999 |
| JP | 11282419 | | 10/1999 |
| JP | 2000056847 | | 2/2000 |
| JP | 200081607 | | 3/2000 |
| JP | 2001134217 | | 5/2001 |
| JP | 2001195014 | | 7/2001 |
| JP | 2002055654 | | 2/2002 |
| JP | 200291376 | | 3/2002 |
| JP | 2002514320 | | 5/2002 |
| JP | 2002-278513 | | 9/2002 |
| JP | 2002333862 | | 11/2002 |
| JP | 2003-076331 | | 3/2003 |
| JP | 2003099000 | | 4/2003 |
| JP | 2003124519 | | 4/2003 |
| JP | 2003173165 | | 6/2003 |
| JP | 2003177709 | | 6/2003 |
| JP | 2003186439 | | 7/2003 |
| JP | 2003195809 | | 7/2003 |
| JP | 2003271095 | | 9/2003 |
| JP | 2003-308046 | | 10/2003 |
| JP | 2003317944 | | 11/2003 |
| JP | 2004004675 | | 1/2004 |
| JP | 2004054188 | | 2/2004 |
| JP | 2004145197 | | 5/2004 |
| JP | 2004226960 | | 8/2004 |
| JP | 2004287345 | | 10/2004 |
| JP | 2005004147 | | 1/2005 |
| JP | 2005057217 | | 3/2005 |
| JP | 2005099715 | | 4/2005 |
| JP | 2005258326 | | 9/2005 |
| JP | 2005338819 | | 12/2005 |
| JP | 200765015 | | 3/2007 |
| JP | 2008102335 | | 5/2008 |
| JP | 4158570 | | 10/2008 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 569173 | | 1/2004 |
| TW | 1221268 | | 9/2004 |
| TW | 1223092 | | 11/2004 |
| TW | 200526065 | | 8/2005 |
| TW | 1239501 | | 9/2005 |
| TW | 200727247 | | 7/2007 |
| WO | WO 98-11554 | | 3/1998 |
| WO | WO 98-48403 | | 10/1998 |
| WO | 99/48079 | | 9/1999 |
| WO | WO 01-06484 | | 1/2001 |
| WO | 01/27910 | A1 | 4/2001 |
| WO | WO 01-63587 | A2 | 8/2001 |
| WO | WO 02-067327 | A | 8/2002 |
| WO | WO 03-001496 | A1 | 1/2003 |
| WO | 03/034389 | | 4/2003 |
| WO | 03/063124 | | 7/2003 |
| WO | WO 03-058594 | A1 | 7/2003 |
| WO | WO 03-075256 | | 9/2003 |
| WO | WO 03-077231 | | 9/2003 |
| WO | 2004/003877 | | 1/2004 |
| WO | WO 2004-015668 | A1 | 2/2004 |
| WO | WO 2004-025615 | A | 3/2004 |
| WO | 2004/034364 | | 4/2004 |
| WO | WO 2004-047058 | | 6/2004 |
| WO | WO 2004-104975 | A1 | 12/2004 |
| WO | 2005/022498 | | 3/2005 |
| WO | WO 2005-022500 | A | 3/2005 |
| WO | WO 2005-029455 | | 3/2005 |
| WO | WO 2005-029456 | | 3/2005 |
| WO | 2005/055185 | | 6/2005 |
| WO | WO 2005/055186 | A1 | 6/2005 |
| WO | WO 2005-069267 | | 7/2005 |
| WO | WO 2006-000101 | A1 | 1/2006 |
| WO | WO 2006-053424 | | 5/2006 |
| WO | 2006/063448 | | 6/2006 |
| WO | WO 2006-084360 | | 8/2006 |
| WO | WO 2006-128069 | | 11/2006 |

(56) References Cited

FOREIGN PATENT DOCUMENTS

| | | | |
|---|---|---|---|
| WO | WO 2007-003877 | A | 1/2007 |
| WO | WO 2007-079572 | | 7/2007 |
| WO | WO 2007-120849 | A2 | 10/2007 |
| WO | WO 2008-290805 | | 11/2008 |
| WO | WO 2009-048618 | | 4/2009 |
| WO | WO 2009-055920 | | 5/2009 |
| WO | WO 2009-059028 | | 5/2009 |
| WO | WO 2009-127065 | | 10/2009 |
| WO | WO 2010-023270 | | 3/2010 |
| WO | WO 2010-066030 | | 6/2010 |
| WO | WO 2010-120733 | | 10/2010 |
| WO | WO 2011-041224 | A1 | 4/2011 |
| WO | WO 2011-064761 | A1 | 6/2011 |
| WO | WO 2011-067729 | | 6/2011 |
| WO | WO 2012-160424 | A1 | 11/2012 |
| WO | WO 2012-160471 | | 11/2012 |
| WO | WO 2012-164474 | A2 | 12/2012 |
| WO | WO 2012-164475 | A2 | 12/2012 |

OTHER PUBLICATIONS

Ahnood et al.: "Effect of threshold voltage instability on field effect mobility in thin film transistors deduced from constant current measurements"; dated Aug. 2009.
Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Arokia Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
Jafarabadiashtiani et al.: "A New Driving Method for a-Si AMOLED Displays Based on Voltage Feedback"; dated 2005 (4 pages).
Joon-Chul Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
Lee et al.: "Ambipolar Thin-Film Transistors Fabricated by PECVD Nanocrystalline Silicon"; dated 2006 (6 pages).
Ma E Y et al.: "organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Nathan A. et al., "Thin Film imaging technology on glass and plastic" ICM 2000, proceedings of the 12 international conference on microelectronics, dated Oct. 31, 2001 (4 pages).
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED-Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).

(56) References Cited

OTHER PUBLICATIONS

Safavian et al.: "TFT active image sensor with current-mode readout circuit for digital x-ray fluoroscopy [5969D-82]"; dated Sep. 2005 (9 pages).
Stewart M. et al., "polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
International Searching Authority Search Report, PCT/IB2011/051103, dated Jul. 8, 2011, 3 pages.
International Searching Authority Written Opinion, PCT/IB2011/051103, dated Jul. 8, 2011, 6 pages.
European Search Report, Application No. 1175571.0-1903, dated Mar. 19, 2014, 8 pages.
Chapter 3: Color Spaces Keith Jack: "Video Demystified: A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 10 17 5764 dated Oct. 18, 2010 (2 pages).
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Search Report for Application No. EP 01 11 22313 dated Sep. 14, 2005 (4 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Search Report for Application No. PCT/CA2006/000177 dated Jun. 2, 2006.
European Supplementary Search Report Application No. EP 09 80 2309 dated May 8, 2011 (14 pages).
European Supplementary Search Report Application No. EP 09 83 1339.8 dated Mar. 26, 2012 (11 pages).
European Supplementary Search Report for Application No. EP 04 78 6662 dated Jan. 19, 2007 (2 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223., 4 mailed Nov. 8, 2011 (8 pages).
Extended European Search Report Application No. EP 12 17 4465.0 European Patent Office dated Sep. 7, 2012 (9 pages).
Extended European Search Report for Application No. 11 73 9485.8 mailed Aug. 6, 2013(14 pages).
Extended European Search Report for Application No. EP 09 73 3076.5, mailed Apr. 27, (13 pages).
Extended European Search Report for Application No. EP 11 16 8677.0, mailed Nov. 29, 2012, (13 page).
Extended European Search Report for Application No. EP 11 19 1641.7 mailed Jul. 11, 2012 (14 pages).
Extended European Search Report for Application No. EP 14158051.4, mailed Jul. 29, 2014, (4 pages).
Fan et al. "LTPS_TFT Pixel Circuit Compensation for TFT Threshold Voltage Shift and IR-Drop on the Power Line for Amolded Displays" 5 pages copyright 2012.
Fossum, Eric R.. "Active Pixel Sensors: Are CCD's Dinosaurs?" SPIE: Symposium on Electronic Imaging. Feb. 1, 1993 (13 pages).
International Preliminary Report on Patentability for Application No. PCT/CA2005/001007 dated Oct. 16, 2006, 4 pages.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 mailed Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2012/052651 5 pages dated Sep. 11, 2012.
International Search Report Application No. PCT/IB2013/059074, dated Dec. 18, 2013 (5 pages).
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, mailed Mar. 21, 2006 (2 pages).
International Search Report for Application No. PCT/CA2007/000652 dated Jul. 25, 2007.
International Search Report for Application No. PCT/CA2009/000501, mailed Jul. 30, 2009 (4 pages).
International Search Report for Application No. PCT/IB2010/055481, dated Apr. 7, 2011, 3 pages.
International Search Report for Application No. PCT/IB2010/055486, Dated Apr. 19, 2011, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/055135, Canadian Patent Office, dated Apr. 16, 2012 (5 pages).

(56) References Cited

OTHER PUBLICATIONS

International Search Report for Application No. PCT/IB2012/052372, mailed Sep. 12, 2012 (3 pages).
International Search Report for Application No. PCT/IB2013/054251, Canadian Intellectual Property Office, dated Sep. 11, 2013; (4 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
International Search Report for Application No. PCT/JP02/09668, mailed Dec. 3, 2002, (4 pages).
International Searching Authority Written Opinion Application No. PCT/CA2009/001769 dated Apr. 8, 2010 (8 pages).
International Searching Authority Written Opinion Application No. PCT/IB2010/002898 Canadian Intellectual Property Office dated Mar. 30, 2011 (8 pages).
International Searching Authority Written Opinion Application No. PCT/IB2010/055481 dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2013/059074, dated Dec. 18, 2013 (8 pages).
International Written Opinion for Application No. PCT/CA2004/001742, Canadian Patent Office, dated Feb. 21, 2005 (5 pages).
International Written Opinion for Application No. PCT/CA2005/001897, mailed Mar. 21, 2006 (4 pages).
International Written Opinion for Application No. PCT/CA2009/000501 mailed Jul. 30, 2009 (6 pages).
International Written Opinion for Application No. PCT/IB2010/055486, Dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/055135, Canadian Patent Office, dated Apr. 16, 2012 (5 pages).
International Written Opinion for Application No. PCT/IB2012/052372, mailed Sep. 12, 2012 (6 pages).
International Written Opinion for Application No. PCT/IB2013/054251, Canadian Intellectual Property Office, dated Sep. 11, 2013; (5 pages).
Kanicki, J., et al. "Amorphous Silicon Thin-Film Transistors Based Active-Matrix Organic Light-Emitting Displays." Asia Display: International Display Workshops, Sep. 2001 (pp. 315-318).
Karim, K. S., et al. "Amorphous Silicon Active Pixel Sensor Readout Circuit for Digital Imaging." IEEE: Transactions on Electron Devices. vol. 50, No. 1, Jan. 2003 (pp. 200-208).
Lee, Wonbok: "Thermal Management in Microprocessor Chips and Dynamic Backlight Control in Liquid Crystal Displays", Ph.D. Dissertation, University of Southern California (124 pages), Aug. 2008.
Mendes E., et al. "A High Resolution Switch-Current Memory Base Cell." IEEE: Circuits and Systems. vol. 2, Aug. 1999 (pp. 718-721).
Office Action in Japanese patent application No. JP2006-527247 dated Mar. 15, 2010. (8 pages).
Office Action in Japanese patent application No. JP2007-545796 dated Sep. 5, 2011. (8 pages).
Office Action in Japanese patent application No. JP2012-541612 dated Jul. 15, 2014. (3 pages).
Ono et al. "Shared Pixel Compensation Circuit for AM-OLED Displays" Proceedings of the 9$^{th}$ Asian Symposium on Information Display (ASID) pp. 462-465 New Delhi dated Oct. 8-12, 2006 (4 pages).
Partial European Search Report for Application No. EP 11 168 677.0, mailed Sep. 22, 2011 (5 pages).
Partial European Search Report for Application No. EP 11 19 1641.7, mailed Mar. 20, 2012 (8 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Singh, et al., "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler et al., System Considerations for RGBW OLED Displays, Journal of the SID 14/1, 2006, pp. 37-48.
Written Opinion for Application No. PCT/IB2014/059753, Canadian Intellectual Property Office, dated Jun. 12, 2014 (6 pages).
Written Opinion for Application No. PCT/IB2014/060879, Canadian Intellectual Property Office, dated Jul. 17, 2014 (3 pages).
Yu, Jennifer "Improve OLED Technology for Display", Ph.D. Dissertation, Massachusetts Institute of Technology, Sep. 2008 (151 pages).

* cited by examiner

LIFETIME UNIFORMITY PARAMETER EXTRACTION METHODS

CROSS-REFERENCE TO RELATED APPLICATIONS

This application claims priority to Canadian Application No. 2,696,778, which was filed Mar. 17, 2010.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE PRESENT DISCLOSURE

The present invention generally relates to active matrix organic light emitting device (AMOLED) displays, and particularly to improving the spatial and/or temporal uniformity of a display.

BACKGROUND

Organic light emitting diode (OLED) displays have gained significant interest recently in display applications in view of their faster response times, larger viewing angles, higher contrast, lighter weight, lower power, amenability to flexible substrates, as compared to liquid crystal displays (LCDs).

Currently, active matrix organic light emitting device ("AMOLED") displays are being introduced. The advantages of such displays include lower power consumption, manufacturing flexibility and faster refresh rate over conventional liquid crystal displays. In contrast to conventional liquid crystal displays, there is no backlighting in an AMOLED display as each pixel consists of different colored OLEDs emitting light independently. The OLEDs emit light based on current supplied through a drive transistor.

An AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current. Active matrix addressing involves a layer of backplane electronics, based on thin film transistors (TFTs) fabricated using amorphous silicon (a-Si:H), polycrystalline silicon (poly-Si), or polymer technologies, to provide the bias voltage and drive current needed in each OLED based pixel.

AMOLED displays can experience non-uniformity, for example due to manufacturing processes and differential ageing. Individual pixels of an AMOLED display may age differently from other pixels due to the images displayed on the display over time. Ageing of both the TFT backplane and the OLEDs for a particular pixel can separately contribute to the ageing of that pixel. Additionally, different color OLEDs are made from different organic materials, which age differently. Thus, the separate OLEDs for a pixel may age differently from one another. As a result, the same drive current may produce a different brightness for a particular pixel over time, or a pixel's color may shift over time. Measuring the status (e.g., ageing, non-uniformity, etc.) of an AMOLED display can require that each individual pixel be measured. This requires a great many measurements, and a number of measurements that increases as the number of pixels increases.

SUMMARY

Aspects of the present disclosure include a method of evaluating OLED display pixel status (e.g., pixel ageing and/or pixel non-uniformity). The method includes generating a sequence of patterns representing pixel values for a display panel, wherein the sequence of patterns is a subset of a full sequence of patterns and driving the OLED panel with the sequence of patterns. A sequence of values representing the responses of the panel to the respective ones of the sequence of patterns is sensed and a matrix of status values representing pixel status of the panel is derived from the sensed sequence of values. The matrix of status values is stored in a memory, and can be used in applying a correction signal to the display. The patterns can be generating using, for example, discrete cosine transformations, wavelet transformations, or principal component analysis. Measurements can be taken while operating the display at multiple operating points (e.g., driving transistors in a saturation region and a linear region), allowing status values to be extracted for multiple discrete display characteristics (e.g., driving transistor TFT ageing and OLED pixel ageing).

According to another aspect of the disclosure, an apparatus for evaluating OLED display status (e.g., ageing and/or non-uniformity) includes a pattern generator configured to generate a sequence of pixel patterns, wherein the sequence of patterns is a subset of a full sequence of patterns. A pixel driver coupled to the pattern generator is configured to drive a display panel with the sequence of pixel patterns. A sensor is configured to sense a panel response value corresponding to a pattern generated by the pattern generator and an extraction module coupled to the sensor is configured to extract a set of status values corresponding to each of the pixels of the panel from the panel response values. A memory configured to store the set of status values. A correction module coupled to the pixel driver can generate a set of correction signals corresponding to the status values. The patterns can be generating using, for example, discrete cosine transformations, wavelet transformations, or principal component analysis. Measurements can be taken while operating the display at multiple operating points (e.g., driving transistors in a saturation region and a linear region), allowing status values to be extracted for multiple discrete display characteristics (e.g., driving transistor TFT ageing and OLED pixel ageing).

In another aspect of the disclosure, a method of deriving a sequence of OLED status test patterns includes generating a full sequence of display patterns according to a transform function (such as discrete cosine transform and/or wavelet transform) and driving a display with each of the sequence of patterns. The method further includes sensing a property of the display for each of the sequence of patterns and deriving a pixel status model using the sensed properties and an inverse of the transform function. The method further includes identifying and deleting patterns of the sequence of patterns that contribute less than a threshold amount to the status model to derive a sparse sequence of patterns. The sparse sequence of patterns is stored in a memory.

The method can also include generating the sparse sequence of patterns, driving the display with each of the sparse sequence of patterns, and sensing a property of the display for each of the sparse sequence of patterns. A set of pixel status values (e.g., ageing and/or non-uniformity) can be extracted from the sensed properties. The pixel status values can be stored in the memory.

The present invention helps improve the display uniformity and lifetime despite instability and non-uniformity of individual devices and pixels. This technique is non-invasive and can be applied to any type of display, including AMOLED displays, and can be used as a real-time diagnostic tool to map out or extract device metrics temporally or spatially over large areas.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
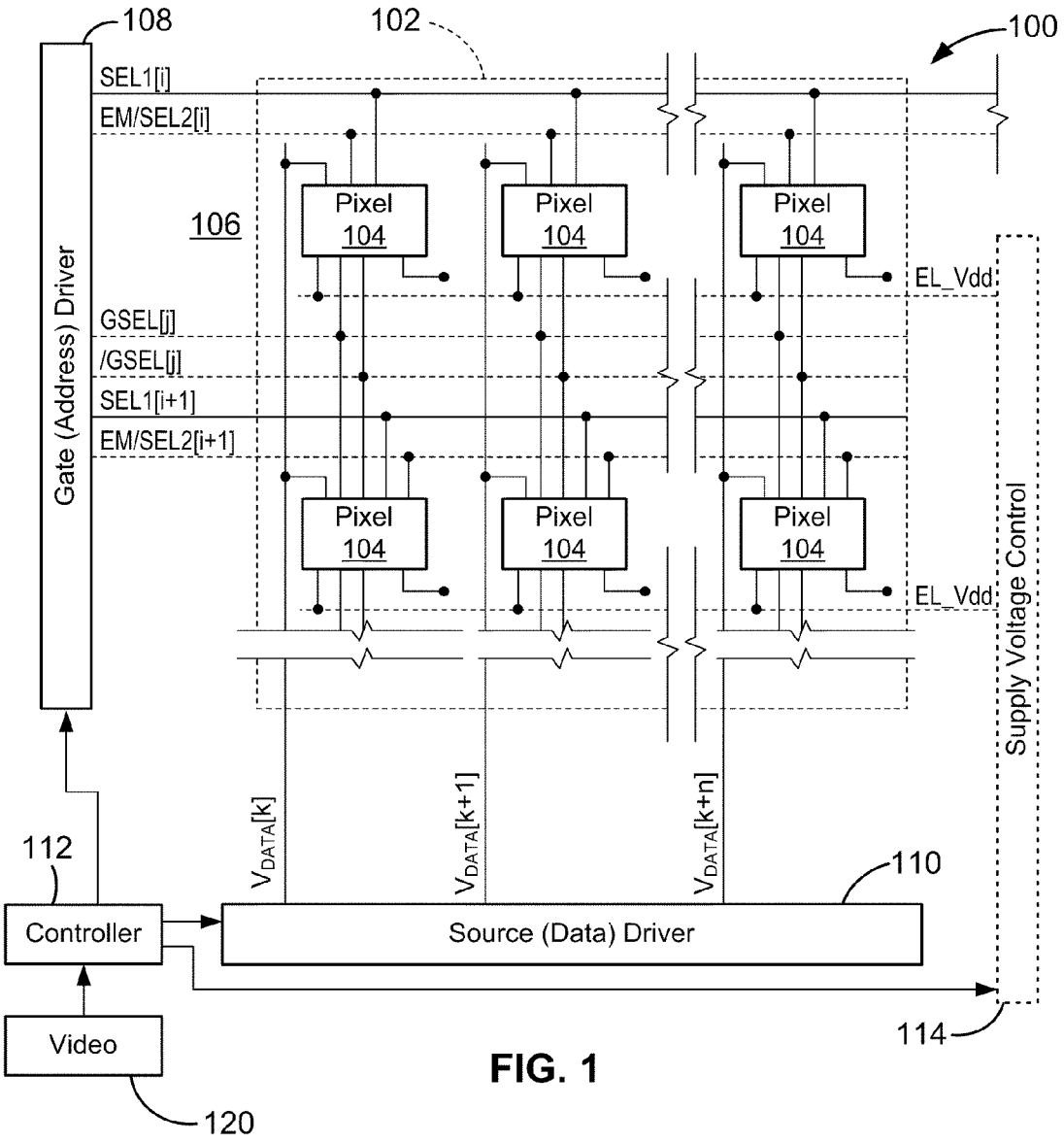
FIG. 1 is a block diagram of an AMOLED display.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is an electronic display system 100 having an active matrix area or pixel array 102 in which an array of pixels 104 are arranged in a row and column configuration. The display system 100 can be, for example, an AMOLED display. For ease of illustration, only two rows and columns are shown. External to the active matrix area of the pixel array 102 is a peripheral area 106 where peripheral circuitry for driving and controlling the pixel array 102 is disposed. The peripheral circuitry includes a gate or address driver circuit 108, a source or data driver circuit 110, a controller 112, and a supply voltage (e.g., Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. A video source 120 feeds processed video data into the controller 112 for display on the display system 100. The video source 120 represents any video output from devices using the display system 100 such as a computer, cell phone, PDA and the like. The controller 112 converts the processed video data to the appropriate voltage programming information for the pixels 104 in the display system 100.

In pixel sharing configurations described below, the gate or address driver circuit 108 can also optionally operate on global select lines GSEL[j] and optionally /GSEL[j], which operate on multiple rows of pixels 104 in the pixel array 102, such as every two rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of a brightness of each light emitting device in the pixel 104. A storage element, such as a capacitor, in each pixel 104 stores the voltage programming information until an emission or driving cycle turns on the light emitting device. The supply voltage driver 114, under control of the controller 112, controls the level of voltage on a supply voltage (EL_Vdd) line, one for each row of pixels 104 in the pixel array 102. Alternatively, the voltage driver 114 may individually control the level of supply voltage for each row of pixels 104 in the pixel array 102 or each column of pixels 104 in the pixel array 102. As will be explained, the level of the supply voltage is adjusted to conserve power consumed by the pixel array 102 depending on the brightness required.

As is known, each pixel 104 in the display system 100 needs to be programmed with information indicating the brightness of the organic light emitting device in the pixel 104 for a particular frame. A frame defines the time period that includes a programming cycle or phase during which each and every pixel in the display system 100 is programmed with a programming voltage indicative of a desired brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all the pixels are then driven row-by-row. Either scheme can employ a brief vertical blanking time at the beginning or end of each frame during which the pixels are neither programmed nor driven.

The components located outside of the pixel array 102 can be disposed in a peripheral area 106 around the pixel array 102 on the same physical substrate on which the pixel array 102 is disposed. These components include the gate driver 108, the source driver 110 and the supply voltage controller 114. Alternatively, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations can include the gate driver 108 and the source driver 110 but not the supply voltage controller 114.

The use of the AMOLED display system 100 in FIG. 1 for applications with bright backgrounds such as emails, Internet surfing, etc., requires higher power consumption due to the need for each pixel to serve as a light for such applications. However, the same supply voltage applied to the drive transistors of each pixel is still used when the pixel is switched to varying degrees of gray scales (brightness). The current example therefore manages the supply power of the drive transistors for video data that requires higher brightness, therefore resulting in power savings while maintaining the necessary luminescence compared to an ordinary AMOLED display with a constant supply voltage to the drive transistors.

Figure 2:
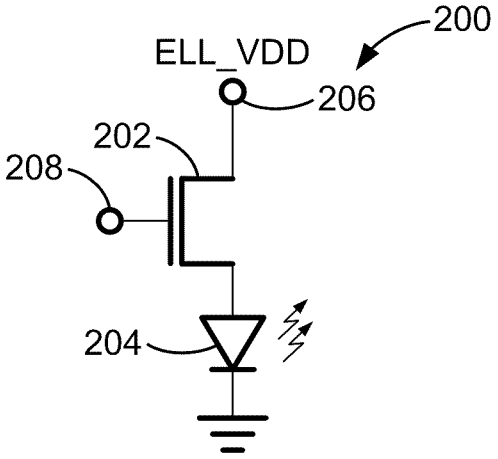
FIG. 2 is a block diagram of a pixel driver circuit for the AMOLED display in FIG. 1.

FIG. 2 is a circuit diagram of a simple individual driver circuit 200 for a pixel such as the pixel 104 in FIG. 1. As explained above, each pixel 104 in the pixel array 102 in FIG. 1 is driven by the driver circuit 200 in FIG. 2. The driver circuit 200 includes a drive transistor 202 coupled to an organic light emitting device 204. In this example, the organic light emitting device 204 is a luminous organic material which is activated by current flow and whose brightness is a function of the magnitude of the current. A supply voltage input 206 is coupled to the drain of the drive transistor 202. The supply voltage input 206 in conjunction with the drive transistor 202 supplies current to the light emitting device 204. The current level may be controlled via a programming voltage input 208 coupled to the gate of the drive transistor 202. The programming voltage input 208 is therefore coupled to the source driver 110 in FIG. 1. In one example, the drive transistor 202 is a thin film transistor fabricated from hydrogenated amorphous silicon. In another example, low-temperature polycrystalline-silicon thin-film transistor ("LTPS-TFT") technology can also be used. Other circuit components such as capacitors and transistors (not shown) may be added to the simple driver circuit 200 to allow the pixel to operate with various enable, select and control signals such as those input by the gate driver 108 in FIG. 1. Such components are used for faster programming of the pixels, holding the programming of the pixel during different frames and other functions.

When the pixel 104 is required to have a defined brightness in applications, the gate of the drive transistor 202 is charged to a voltage where the transistor 202 generates a corresponding current to flow through the organic light emitting device 204, creating the required brightness. The voltage at the gate of the transistor 202 can be either created by direct charging of the node with a voltage or self-adjusted with an external current.

A pattern generator generates a predetermined sequence of patterns for display on a panel display. A pattern is simply a matrix of information that tells a display panel driver the level at which to drive each pixel of the display panel to form a visual image. Each of the sequence of patterns is applied to the display, one at a time. A measurement of a display property is taken for each of the sequence of patterns. For example, the overall display panel current can be measured each time a pattern is displayed on the display panel.

An individual measurement taken of the display panel for a single pattern does not give definitive information about the status (e.g., ageing, non-uniformity, etc.) of each pixel of the display panel. It does provide some information, though. For example, a pattern that causes the display panel to display white in the middle and black in the corners can be used to extract an estimate of the status of the pixels in the center of the display panel. Similarly, a pattern that causes the display panel to display black in the middle and white in the corners can be used to extract an estimate of the status of the pixels in the corners of the display. These are examples of low frequency patterns—there is a low frequency of change from pixel to pixel. A checkerboard pattern is an example of a higher frequency pattern, where there is a higher frequency of change from pixel to pixel.

A few measurements can be used to form a crude estimate of the status of the pixels in the display panel. Increasing the number of patterns and corresponding measurements increases the accuracy of the estimate of individual pixel status. By applying every possible pattern and measuring the corresponding results, there is enough information to mathematically determine an exact status value (e.g., ageing value, non-uniformity value, etc.) of each pixel. According to an aspect of the invention, certain patterns can be chosen to optimize the amount of information that can be extracted from a reduced number of patterns. Thus, accurate estimates of the status of the individual pixels can be determined without applying every possible pattern.

The status of the pixels can be represented mathematically as a vector, A. The goal is to mathematically compute each individual value in the vector A. The display panel measurements can be used to compute another vector, M, an example of which is provided below. Matrix multiplication can then be used to solve for each individual pixel value in the vector A using the values in M. An orthogonal transformation matrix, W, can be used in this computation. The transformation W can be used to create the patterns, and the inverse of that transformation, $W^{-1}$, can be used to solve for the individual values of vector A based on the measurements resulting from the patterns. Specifically, the values of A can be calculated according to the equation $A=W^{-1}\times M$.

Figure 3:
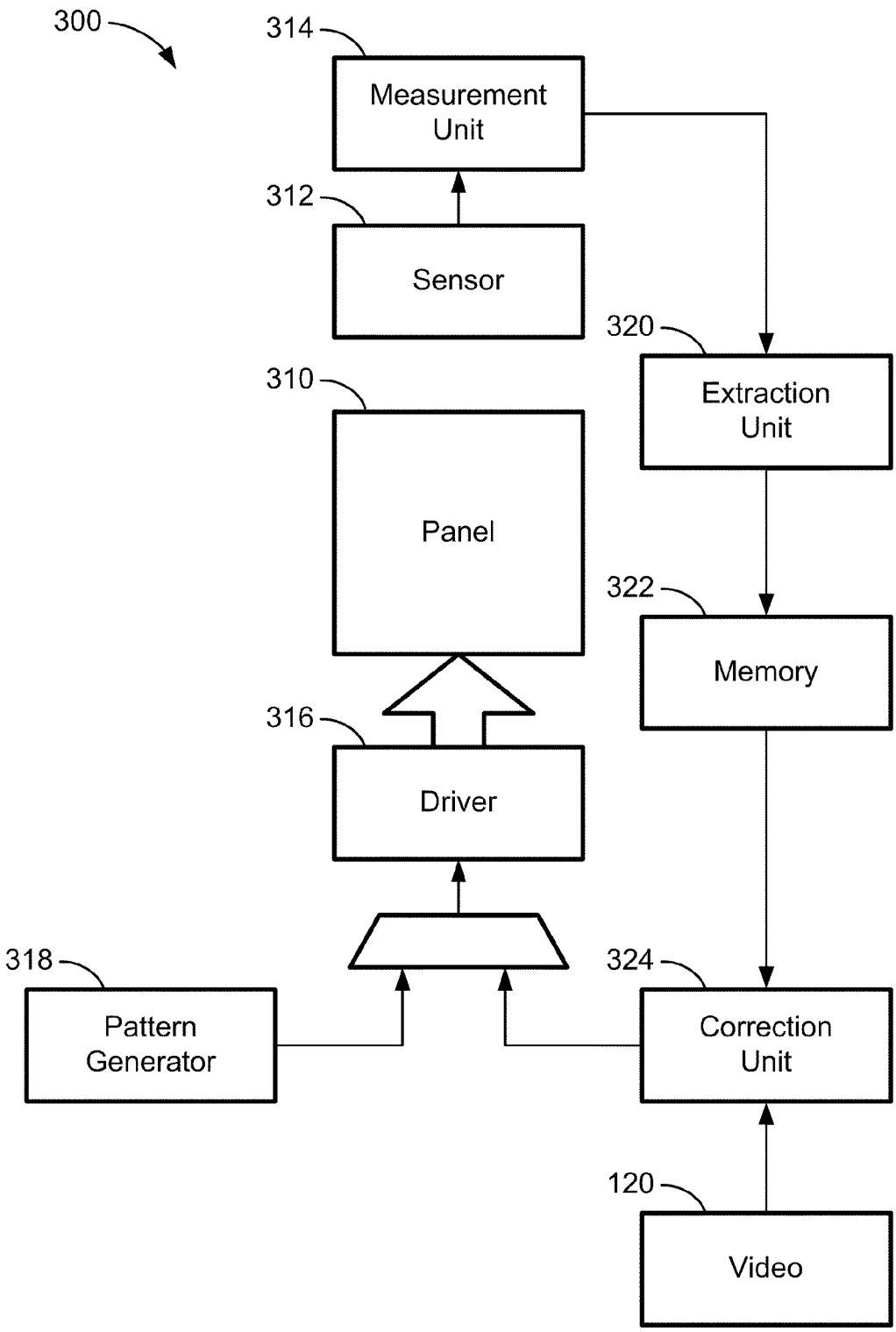
FIG. 3 is a block diagram of a system for measuring and correcting for AMOLED display non-uniformity.

FIG. 3 illustrates an embodiment of a system 300 to measure properties of a display 310, such as an AMOLED panel display, to capture pixel metrics, for example ageing or non-uniformity. In the example of system 300, the display panel 310 is measured with a single sensor 312 (or multiple sensors) rather than a sensor corresponding to each pixel of the display. A person of ordinary skill in the art would recognize that more than one sensor could be used, although the number of sensors is small relative to the number of pixels of the display panel 310. The sensor 312 is, for example, a current sensor that measures the power supply current through $V_{DD}$ and/or $V_{SS}$ lines (e.g., $V_{DD}$ 200 of FIG. 2). Alternatively, the sensor 312 could be an optical sensor, for example measuring the total light output of the display panel 310, or a thermal sensor, for example measuring the heat output of the display panel 310. A measurement unit 314 receives the output of the sensor 312.

Figure 4:
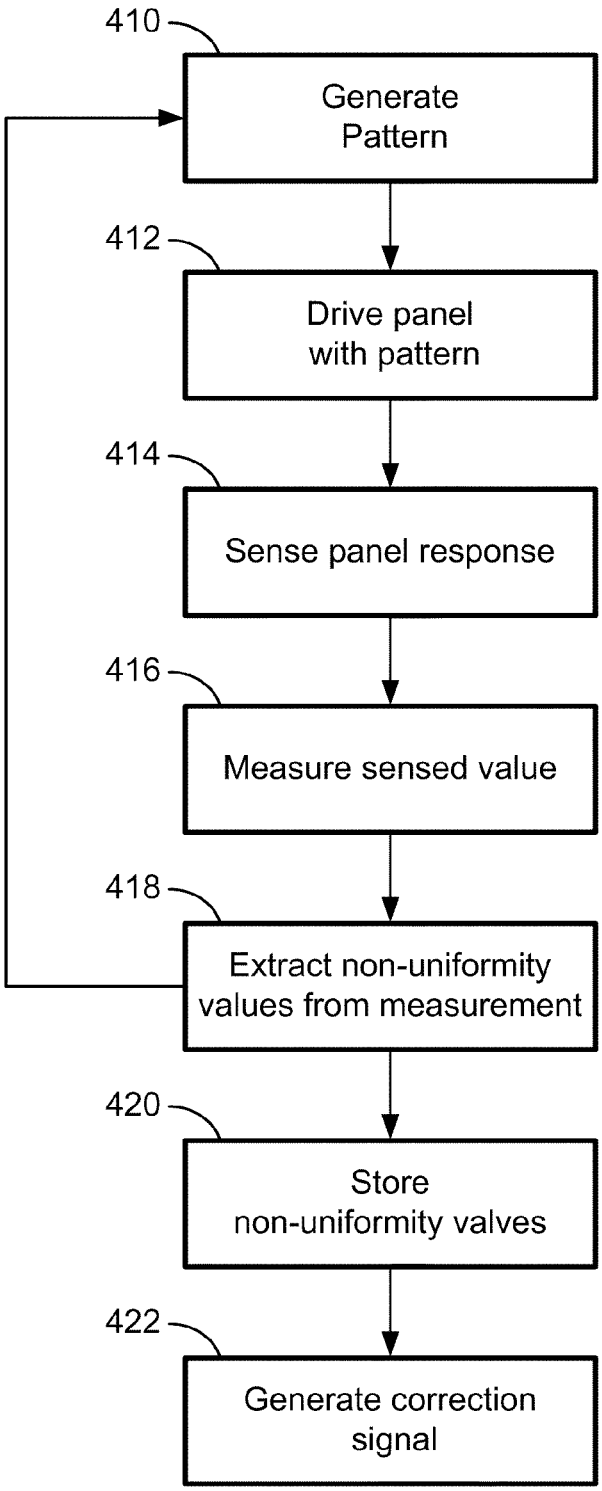
FIG. 4 is a flowchart of a method of extracting non-uniformity information for AMOLED displays.

As shown in FIG. 3, and further in FIG. 4, a pattern generator 318 generates a pattern representative of an image for display on the display panel 310 (Step 410). A pattern can include a two-dimensional image of pixels (e.g., during a frame), with numerical brightness values (e.g., values in a range of 0-255) for each sub-pixel. The display panel 310 is driven by driver 316 (Step 412). The driver 316 can include, for example, the gate driver 108 and the source driver 110 of FIG. 1. During a period of pixel metrics extraction, the driver 316 is programmed to drive the display panel 310 with patterns generated by a pattern generator 318. The driver 316 converts the patterns into electrical signals to drive the display panel 310. The sensor 312 senses the response from the display panel 310 caused by the pattern driven by the driver 316 (Step 414).

The output of the sensor 312 is measured by the measurement unit 314, which converts the sensor 312 output into numerical measurement values (Step 416). The output of the measurement unit 314 is passed to an extraction unit 320 coupled to the measurement unit 314. The extraction unit 320 converts the measured data to values representing the status of individual pixels (Step 418). The patterns generated by the pattern generator 318 can be created according to a waveform transformation. The extraction unit 320 then evaluates the measurements from the measurement unit 314 using the inverse of the waveform transformation used in generating the patterns. For example, the extraction unit 320 can implement a sub-pixel electrical model and an ageing or parameter transformation. The extraction unit 320 can iteratively calculate the status values, for example updating approximations of the pixel status values as it receives additional measurements. Extraction of status data (such as ageing) through the use of a sensor and model characterizing the display (such as a sub-pixel electrical model) allows the display to be tested in a non-invasive fashion.

The status values can be stored in a memory 322 (Step 420). The stored status values can be used by a correction unit 324 coupled to the memory 322 to compensate for the ageing, non-uniformity, and other effects determined by the extraction unit 320 (Step 422). For example, the system 300 receives an input video signal 120 for display on the display panel 310. The input video signal 120 can be received by the correction unit 324, which can adjust the signal for each pixel or sub-pixel to compensate for the determined ageing of that pixel or sub-pixel.

Figure 5:
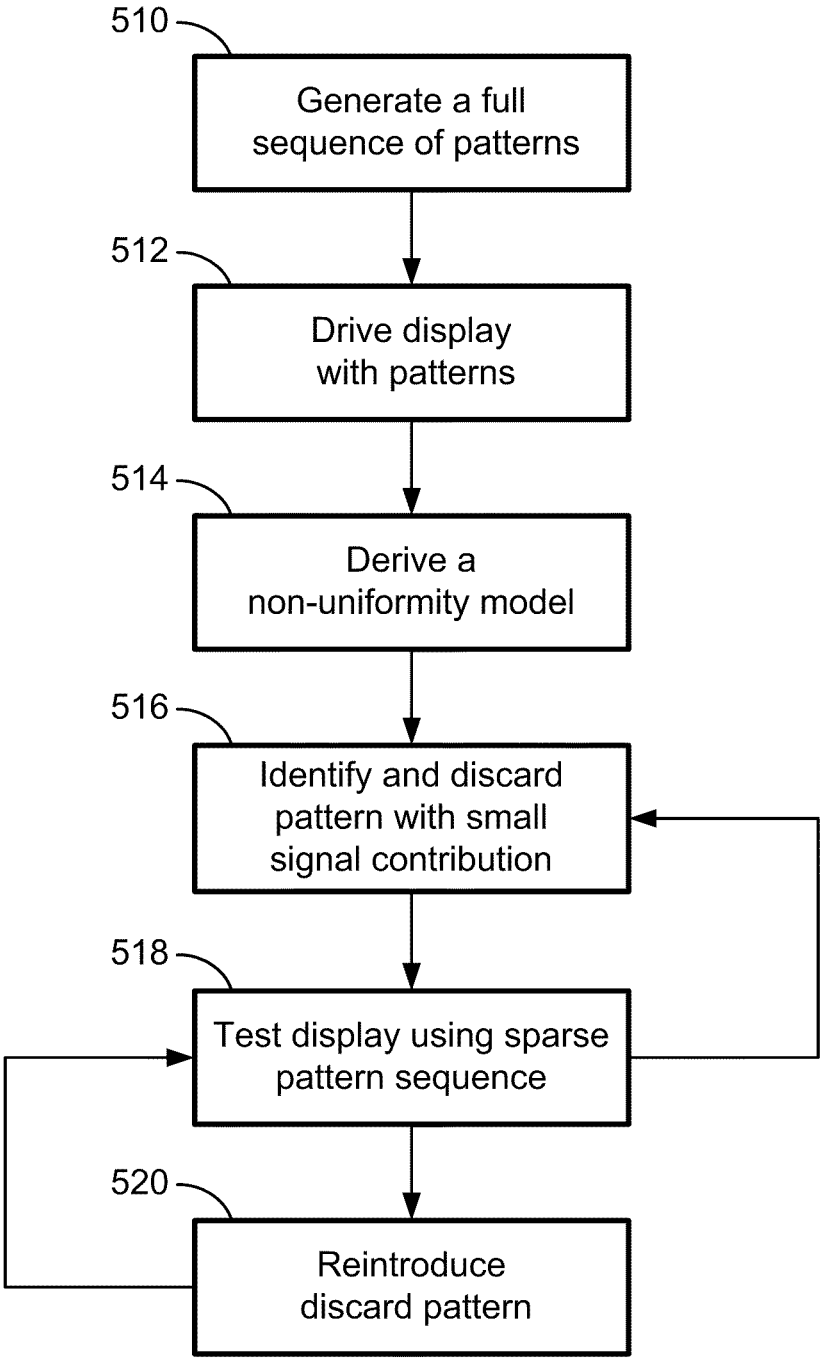
FIG. 5 is a flowchart of a method of developing a non-uniformity model for an AMOLED display.

As shown in FIG. 5, the display 310 can be initially tested using a full set of patterns. As explained below, this can correspond to four times the number of pixels in the panel display. In this case, the pattern generator 318 iteratively generates each of the full sequence of patterns (Step 510), and the driver 316 causes the display panel 310 to display images corresponding to those patterns (Step 512). The extraction unit 320 derives a non-uniformity model based on the responses of the display panel 310 to the patterns (Step 514). The extraction unit can identify which of the full set of patterns contributes the most to the non-uniformity model (e.g., above a threshold value) and which patterns contribute the least (e.g., below the threshold value). The patterns that contribute the least can be discarded (Step 516).

In a subsequent test of the display panel 310, the pattern generator can generate a sequence of patterns that excludes the discarded patterns (Step 518). The extraction unit 320 can re-evaluate the non-uniformity model and discard additional patterns if it identifies patterns that contribute little to the non-uniformity model. Since display status may be difficult to predict, a discarded pattern may turn out to have more value in the future. Accordingly, discarded patterns can be re-introduced (Step 520), and the display panel 310 can be tested with a pattern sequence including the formerly discarded pattern.

A. Sub-Pixel Electrical Models

The extraction unit 320 can be configured to evaluate display status, such as display ageing, using a sub-pixel electrical model. To extract the ageing of each sub-pixel, the extraction unit 320 can construct a model for the sensor output for each sub-pixel based on the input of the sub-pixel. The model can be based on measuring the output of the sensor 312 (e.g. supply current) for a sequence of applied images (generated by pattern generator 318), and then extracting, using the extraction unit 320, a parameter matrix of the TFT and/or OLED current-voltage (I-V) ageing or mismatch values.

The supply current $I_2$ of a sub-pixel biased in the saturation region follows a power-law relation with respect to input data voltage as:

$$I_2=\beta_1(V_G-V_{os}-V_{Ta}-V_{Oa})^a \quad (1)$$

Where $\beta_1$, $V_{os}$, and a, are model coefficients, $V_G$ is the gate voltage of the driving TFT (e.g., transistor 202 of FIG. 2) equal to the voltage of the input video signal from the driver 316. $V_{Oa}$ and $V_{Ta}$ are the ageing voltage of the OLED and TFT (e.g., OLED 204 and transistor 202 of FIG. 2) such that to maintain their currents to the level equal to when they were not aged, a higher voltage ($V_{Oa}+V_{Ta}$) can be used. This model is valid for $V_G>V_{os}+V_{Ga}+V_{Ta}$.

The supply current $I_2$ of a sub-pixel can also be modeled with the driving transistor in the linear region, where the supply voltage $V_{DD}$ is pulled down significantly. The operation in the linear region can be used to decompose ageing estimations into the OLED and TFT portions. The current $I_2$ of the driving transistor in the linear region can be approximated by:

$$I_2=\beta_1(V_G-V_{os}-V_{Ta}(y+\theta V_G)V_{Oa}) \quad (2)$$

Where $\beta_1$, $V_{ot}$, y, $\theta$ are model coefficients.

Values for the coefficients of the models of Equations (1) and (2) can be determined by supplying to the panel 310 patterns generated by the pattern generator 318 including solid mono-color (red, green, or blue) gray-scale images, and measuring the sensor 312 output (e.g., the supply current of the whole panel) corresponding to each pattern. In this example, the extraction unit 320 can include a look-up-table that maps the gray-scale to the gate voltage, $V_G$. The extraction unit 320 can then use the measured currents to fit the models. The patterns applied by the pattern generator 318 can be constructed under a short range of the gray-scale, to fit the models with the gray-scale range that is actually being used throughout the ageing profile extraction, rather than the full 0-255 range.

Instead of, or in addition to driving the driving transistors of the panel alternately in the linear and saturation regions, the driving transistors can be driven with voltages offset by an offset value. For example, a first set of measurements can be taken with the driving transistors driven with no offset (e.g., a DC offset of zero, or a gray scale value of 127). A second set of measurements can be taken with the driving transistors driven with a DC offset or bias. From these two sets of measurements, two discrete display characteristics (e.g., driving transistor TFT ageing and OLED pixel ageing). Moreover, the driving transistors can be driven in more than two operating positions (e.g., three discrete offset points, multiple offset points and saturation region, etc.) to generate measurements for evaluating more than two discrete display characteristics.

B. Direct Extraction of Ageing and Non-Uniformity Profiles' Transformations

As explained above, the ageing values of the pixels of a display panel can be represented as a vector. For example, the ageing of the pixels and sub-pixels of the display 310 can be represented as a vector of numerical values, A. Likewise, the display panel measurements can be used by the extraction unit 320 to calculate a vector M to help solve for the ageing values in A.

The pattern generator 318 generates a sequence of patterns that are used by the driver 316 to generate images on the display 310. Each pattern represents a two-dimensional matrix of pixel values. Different patterns cause images to be displayed that carry different information about the display's ageing. For example, a pattern can be generated that results in an image that is all white. The measurement taken from this image represents the ageing of the entire display 310. Another pattern can be generated that results in an image that is white in the center and dark in the corners. The measurement taken from this image represents the ageing in the middle of the display 310. The extraction unit 320 can obtain an accurate calculation of the ageing values for each of the pixels and sub-pixels by evaluating a sufficient number of measurements corresponding to patterns supplied by the pattern generator 318 and computing a matrix of ageing values.

The orthogonal transformations of the ageing and non-uniformity profiles of the display 310 can be directly obtained by applying proper image sequences using the pattern generator 318 and measuring the corresponding output of the sensor 312 (e.g., supply current).

For example, the display 310 can be represented as an rxc pixel matrix (matrix of size r rows times c columns). The $V_{Ta}+V_{Oa}$ ageing values of the pixels in the matrix can be rearranged in a column vector A of length rxc so that the first column of the pixel matrix consisting of r pixels sits on top of the vector A.

$W_{rcxrc}$ is an orthogonal transformation matrix (that is $W^{-1}=W^T$). If the vector of $M_{rcx1}=W_{rcxrc}\times A_{rcx1}$ can be obtained by any means, then A, the vector of all $V_{Ta}+V_{Oa}$ ageing values for the display 310, can be recovered by: $A=W^T\times M$. In practice, this large matrix multiplication can be reduced to very fast forms of computations. For example if W is a transformation matrix of a two-dimensional discrete cosine transform (DCT), the matrix multiplication can be reduced to the inverse DCT operation.

The extraction unit 320 can include a microprocessor configured to compute the vector M as follows. The total supply current I for the panel 310 for a pattern supplied to the panel 310 can be represented by the equation:

$$I = \beta_2 \sum_{i=1}^{rc} (V_G(i) - V_{OS} - A(i))^a = \beta_2 \sum_{i=1}^{rc} \left( (V_G(i) - V_{OS})^a \left(1 - \frac{A(i)}{V_G(i) - V_{OS}}\right)^a \right) \tag{3}$$

By using the Taylor approximation of $1-x^a \sim 1-ax$, the Equation (3) can be approximated as:

$$I = \beta_2 \sum_{i=1}^{rc} ((V_G(i) - V_{OS})^a - a(V_G(i) - V_{OS})^{a-1} A(i)) \tag{4}$$

The pattern generator 318 can generate two different patterns (vectors) to be applied as images, $V_{G1}$ and $V_{G2}$, to the display 310, and their corresponding supply currents, $I_1$ and $I_2$, can be measured using the measurement unit 314. $V_{G2}$ can be the negative of $V_{G1}$, for example. The following equation can be derived using the measurements of $I_1$ and $I_2$:

$$\frac{I_2 - I_1}{\beta_2} - \sum_{i=1}^{rc} ((V_{G2}(i) - V_{OS})^a - (V_{G1}(i) - V_{OS})^a) = \sum_{i=1}^{rc} a((V_{G1}(i) - V_{OS})^{a-1} - (V_{G2}(i) - V_{OS})^{a-1}) A(i) \tag{5}$$

Equation (5) can be used to generate the B times of the j-th element of vector M, for i={1, . . . , rc}:

$$a((V_{G1}(i)-V_{os})^{a-1}-(V_{G2}(i)-V_{os})^{a-1})=B-W(j,i) \tag{6}$$

To obtain the j-th element of M two patterns can be supplied with the following gate voltages:

$$V_{G1}(i) = \left(C + B\frac{W(j,i)}{2a}\right)^{\frac{1}{a-1}} + V_{OS}$$
$$V_{G2}(i) = \left(C - B\frac{W(j,i)}{2a}\right)^{\frac{1}{a-1}} + V_{OS} \tag{7}$$

The values of B and C can be calculated using the maximum absolute value of the j-th row of W and a gate voltage range that turns pixels on but does not overdrive them. For example, for i={1, . . . , rc}, if the max([W(j,i)])=$W_i$ and the proper gate voltage range is between $v_{min}$ and $v_{max}$ then:

$$C = 0.5((v_{max} - V_{OS})^{a-1} + (v_{min} - V_{OS})^{a-1})$$
$$B = \frac{a}{w_j}((v_{max} - V_{OS})^{a-1} - (v_{min} - V_{OS})^{a-1}) \tag{8}$$

The extraction unit 320 can compute the two patterns corresponding to $V_{G1}$ and $V_{G2}$ gate voltages by using the look-up table that maps the gray-scale level to voltage. The supply currents can be measured for each pair of images and the corresponding element of the M vector can be calculated using the left hand side of Equation (5) divided by B. The extraction unit 320 can be configured to compute an estimation of the OLED plus TFT ageing profile for the vector A by performing an inverse transformation over M using $W^T$.

The vector A can be computed iteratively, and the error introduced by the first order Taylor approximation can be compensated for by using the estimated A and a previous computation of A, $A_{old}$, and rewriting Equation (5) as:

$$\sum_{i=1}^{rc} a((V_{G1}(i) - V_{OS})^{a-1} - (V_{G2}(i) - V_{OS})^{a-1}) A(i) \tag{9}$$

Iterating over Equation (9) gradually removes the errors of the high order terms neglected in the Taylor approximation. The iteration can be continued until the error is less than a threshold value.

The vector A includes values representing the sum of the OLED and TFT ageing, but not the individual contributions from OLED and TFT ageing separately. The individual contributions of the OLED and TFT ageing can also be obtained. To determine the individual contributions, the drain bias voltage of the TFTs (e.g., the transistor 202 of FIG. 2) can be pulled to a point where the sub-pixels operate in the linear region. In that region, the current of a TFT is a function of drain-source voltage. To compensate for the OLED ageing, a higher absolute voltage value must be applied to the TFT gate than a value corresponding to the actual amount of the OLED ageing. That is because of the fact that the higher OLED voltage that generates the same OLED current also lowers the drain-source voltage. The lowered drain-source voltage must be compensated with even higher gate voltage. This is modeled in Equation (2) as a $V_{G-}$ dependent factor of the OLED ageing, $V_{oa}$.

The supply current in the linear region can be represented by the equation:

$$I = \beta_1 \sum_{i=1}^{rc} (V_G(i) - V_{ot} - A(i) + V_{oa}(i) - (y + \theta V_G(i))V_{oa}(i)) \quad (10)$$

Therefore, $$\frac{I_2 - I_1}{\beta_2} - \sum_{i=1}^{rc} ((V_{G2}(i) - V_{ot} - A(i)) - (V_{G2}(i) - V_{ot} - A(i))) = \sum_{i=1}^{rc} ((V_{G1}(i) - V_{G2}(i))\theta V_{oa}(i)) \quad (11)$$

A suitable gate voltage within a preferred range that creates the B times of j-th element of vector M is $$V_{G1}(i) = C + B\frac{W(j, i)}{2\theta} \quad (12)$$

$$V_{G2}(i) = C - B\frac{W(j, i)}{2\theta}$$

where $$C = 0.5(v_{max} + v_{min}) \quad (13)$$

$$B = \frac{\theta}{w_j}(v_{max} - v_{min})$$

To exactly extract the OLED and TFT ageing values, 4 rc measurements, corresponding to 4 rc patterns, are needed. 4 rc corresponds to each of the rc patterns, its negative, and the corresponding measurements with the TFTs in the linear region to differentiate OLED ageing from TFT ageing. However, according to the present invention, an approximate estimation of ageing can be obtained with only a subset of the 4 rc measurements, corresponding to, for example, a few rows of M. A vector A is called R-Sparse if its transformation using the W transformation matrix (dictionary) can be well approximated with only R nonzero elements. When a suitable transformation is used, and only the rows of W that generate significant nonzero elements in M are used, the reconstruction of ageing can be performed with a significantly lower number of patterns and current measurements. Appropriate reduced sequences of patterns can be selected in a number of ways.

1. Discrete Cosine Transformation

A reduced set of patterns can be identified using a two-dimensional discrete cosine transformation (DCT). The pattern generator 318 can generate patterns created using a DCT. The extraction unit 320 then evaluates the measurements from the measurement unit 314 using the inverse of the DCT in constructing a matrix of ageing values.

A DCT is a transformation that expresses a sequence of data points in terms of a sum of cosine functions oscillating at different frequencies. The DCT is well known for its energy compaction behavior; most of the variance (energy) of the signal can be captured by its first transformation coefficients. The two-dimensional DCT rearranged in the W matrix is:

For $n_1=[0, \ldots, c-1]$, $n_2=[0, \ldots, r-1]$, $k_1=[0, \ldots, c-1]$, and $k_1=[0, \ldots, r-1]$:

$$W(k_1 r + k_2 + 1, n_1 r + n_2 + 1) = \frac{2a_{k1}a_{k2}}{\sqrt{rc}}\cos\left[\frac{k_1\pi}{c}(0.5 + n_1)\right]\cos\left[\frac{k_2\pi}{r}(0.5 + n_2)\right] \quad (13)$$

Where $$\begin{cases} a_\Theta = \frac{1}{\sqrt{2}} \\ a_i = 1 \end{cases}$$

$$i \neq 0$$

The energy compaction property of the DCT implies that by using a limited number of rows of W, in particular those rows with small $k_1$ and $k_2$, the major elements of M may be obtained and used to almost exactly reconstruct ageing. The pattern generator 318 can generate a full set of patterns based on the DCT, and the extraction unit 320 evaluates the measurements that result. The extraction unit 320 can then identify the patterns that contribute the most to the major elements of M. In subsequent tests, the pattern generator 318 can generate a reduced sequence of patterns limited to the patterns identified as the best by the extraction unit 320. If only the first few low-spatial frequency harmonics of the ageing profile are considered, the ageing profiles generated can be blurred due to the filtration of the high frequency edges. This can be solved by progressively performing measurements using selected higher frequency patterns during the operation of the display.

Because most of the variance of the signal can be captured by the first transformation coefficients, the extraction unit 320 can begin solving for, and deriving an accurate approximation of, the status values before all of the patterns have been generated and measured.

Figure 11B:
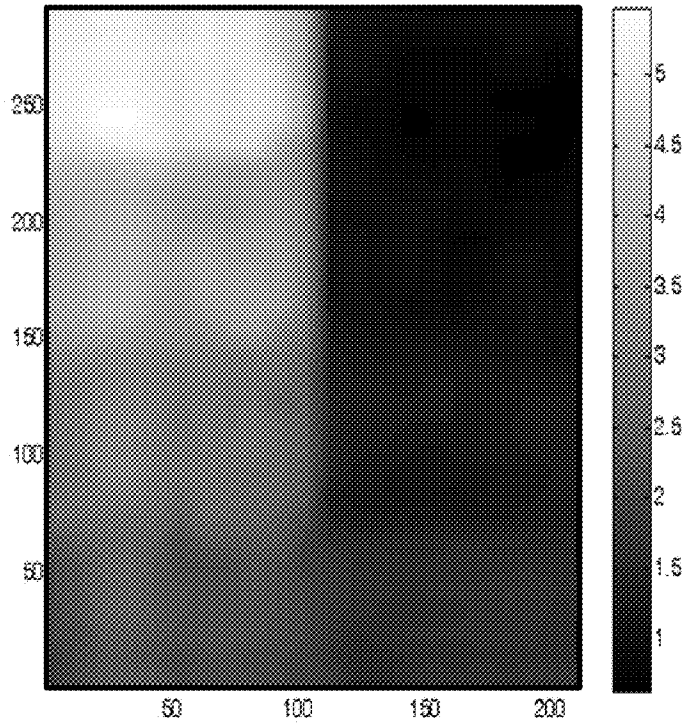
FIG. 11(*a*) is a picture of a pattern applied to a display and FIG. 11(*b*) is picture of an estimate of the ageing of the display obtained using discrete cosine transformations.
Figure 11A:
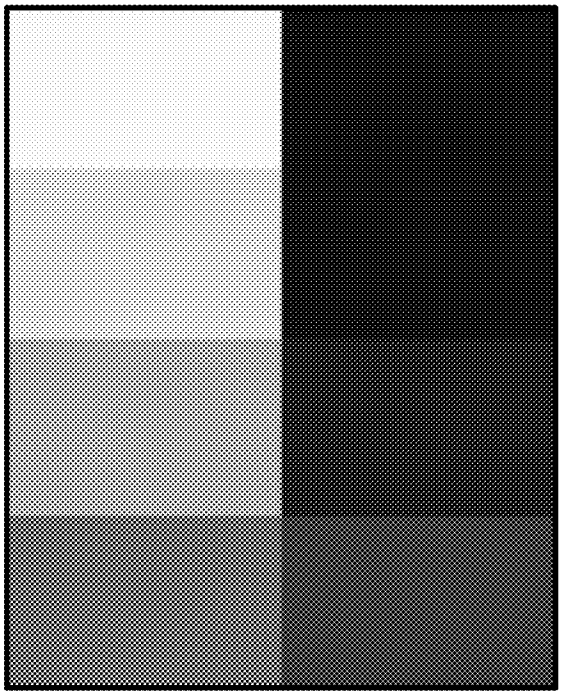

FIG. 11(*a*) shows an example ageing pattern consisting of eight discrete gray-scale blocks from full white to full black on a display of resolution 320 by 240 by RGB pixels. The pattern was applied to the display for forty days at a temperature of 70 degrees Celsius. The display was measured according to the invention using DCT. FIG. 11(*b*) shows an estimate of pixel ageing of the display using 1,000 measurements. As can be seen, a close estimate of the ageing of the display can be obtained with significantly fewer measurements than measuring each pixel individually.

2. Wavelet Transformation

Wavelets can also be used to construct orthogonal transformation matrices. The pattern generator 318 can generate patterns created using a Wavelet Transformation. The extraction unit 320 then evaluates the measurements from the measurement unit 314 using the inverse of the Wavelet Transformation in constructing a matrix of ageing values.

The advantage of wavelet transformations is the high quality detection of the ageing profile high-frequency edges. There are different types of wavelets. Unlike the DCT, with wavelet transformations, there may be a lack of knowledge of where the significant signal transformed coefficients reside. However, the knowledge of a previous ageing extraction profile can be used to find the possible location of the coefficients with significant contribution to the signal energy. The wavelet transformations can be used in conjunction with other methods after finding an initial profile. For example, the pattern generator 318 can generate a set of patterns based on the DCT, and the extraction unit 320 can extract an ageing profile including coefficients with significant contribution to the signal energy from that set of patterns. The pattern generator 318 can then generate, and the extraction unit 320 can evaluate, a set of patterns based on the Wavelet Transformation, leading to better detection of high-frequency edges.

3. Selecting the Optimum Set of Transformation Vectors

For both discrete cosine and wavelet transforms some vectors have more information about the ageing profile of the display 310 than others. To reduce the number of patterns used to extract the ageing accurately, the extraction unit 320 can select the vectors that add more information to the ageing profile and exclude those vectors that add little information. For example, the pattern generator 318 can generate a full set of vectors, using cosine and/or wavelet transforms, from which the extraction unit 320 can identify the vectors that have smaller coefficients, for example below a threshold value, and thus add little to determination of the ageing profile. The extraction unit 320 can then cause those vectors to be dropped from subsequent tests of the display 310. The next time the display 310 is analyzed, the pattern generator 318 can generate a set of patterns that excludes the dropped vectors. The extraction unit 320 can drop vectors iteratively. For example, each time the display 310 is tested, the extraction unit 320 can identify vectors that do not contribute substantially, and cause those to be dropped from subsequent tests.

This method works very well for a device with a fixed ageing profile. For a device with a dynamic ageing pattern, the coefficients of transformation vectors may change. Patterns that were excluded may later turn out to contribute more to the ageing profile, while the included patters may turn out to contribute less. To compensate for a dynamic ageing profile, dropped vectors can occasionally be added back to the set of active vectors in subsequent tests of the display 310, for example randomly or according to cyclic methods.

Because the patterns that contribute most to the status values can be identified, the pattern generator 318 can be configured to generate those patterns first, and the extraction unit 320 can begin solving for, and deriving an accurate approximation of, the status values before all of the patterns have been generated and measured.

4. Principal Component Analysis

Principal component analysis ("PCA") can also be used to generate a dictionary of the most important features that can be used for an efficient decomposition of the ageing profile into a small set of orthogonal basis. The pattern generator 318 can then be configured to use a corresponding set of patterns, and the extraction unit 320 is configured to evaluate the measurements using the information from the principal components dictionary. To utilize PCA, a training set of sample ageing profiles is first constructed. Such a training set can be obtained from the usage pattern of the display 310 in real-time. The training set of sample ageing profiles can also be created from off-line patterns provided by extensive study of possible display usage of a device.

For example, pixel ageing can be studied under several typical usage conditions for a display. A training set of sample ageing profiles can be created for each of these conditions. Training profiles can also be created for particular manufacturers, or displays manufactured at a particular factory, through testing of several samples of displays from that manufacturer or factory. This technique can be used to better match the training profiles to non-uniformity corresponding to the particular manufacturer of factory. The patterns included in the training sets can be represented in the form of a DCT or Wavelet Transformation for ease of extraction.

To create a training set when N ageing profile samples are available, a matrix $P_{rcxN}$ is formed such that each column is an ageing profile rearranged column-by-column in a column vector of size rc. If $S=P\times P^T$, then the eigenvalue vector and eigenvector matrix of Z are $\lambda$ and A. An orthogonal transformation can then be formed by picking the first few eigenvectors corresponding to the largest eigenvalues.

Figure 6:
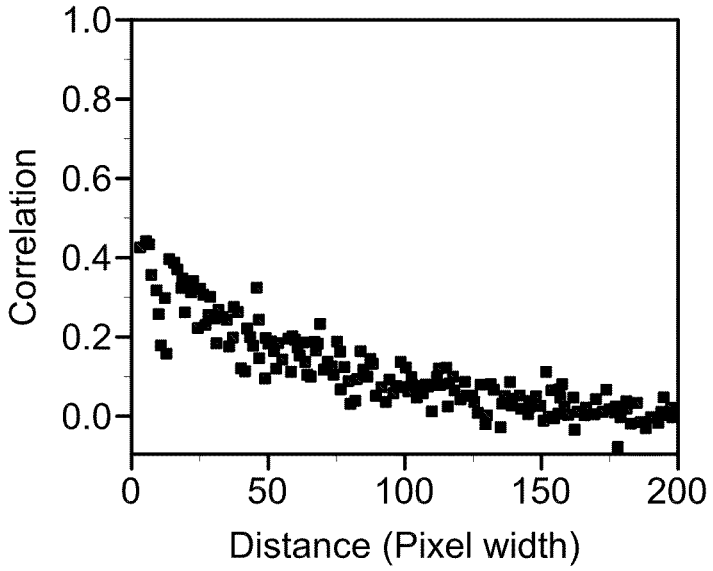
FIG. 6 is a plot of spatial correlation of the panel brightness.

The spatial correlation of a scalar random variable Z on a 2-D plane can be formed by determining the cov(Z(s1), Z(s2)) at any arbitrary locations of s1 and s2. In a second-order stationary process, the spatial covariance is a function of the direction and distance (for an anisotropy process) between the two points rather than their actual position. The correlation generally reduces as the distance increases. There is also a spatial correlation in threshold voltage and mobility of LTPS TFTs known as long-range variation. FIG. 6 shows a plot of spatial correlation of the panel brightness. The correlation reduces as the distance between two points increases.

Since the random parameters are spatially correlated, principal component analysis is very effective in compressing the random parameters. Principal component analysis linearly transforms the underlying data to a new coordinate system such that the greatest variance appears on the first coordinate (the first principal component), the second greatest variance on the second coordinate, and so on. If the profile of the random parameter is decomposed to a weighted sum of the principal components, the dimension of the original data (dimension being the number of sub-pixels for each process parameter) can be significantly reduced in the principal component analysis coordinate system by eliminating the less important principal components.

If $E_Z$ is the spatial covariance matrix of a process parameter Z, $\Sigma_Z(i,j)=\mathrm{cov}(Z(s_i), Z(sj))$, the m principal components of this process parameter is equivalent to the m eigenvectors of $\Sigma Z$ corresponding to its m largest eigenvalues. FIG. 7(*a*)-7(*j*) show ten patterns representing the first ten principal components of the spatial correlation matrix according to the data points of FIG. 6. In this example, the first ten principal components, which capture most of the variance, primarily contain low spatial frequencies, representing global non-uniformity trends.

As a voltage programming pixel, a driving transistor must supply a certain amount of current determined by the OLED optical efficiency, for a given gate voltage, regardless of the OLED bias. Therefore, in this example, the driving transistor of the pixel shown in FIG. 2 is biased in a way that it remains in strong saturation for the entire range of the gray-scale OLED operation. Consequently, the OLED current-voltage ("I-V") shift effect, due to electrical ageing, on the current of the driving TFT will also be minimized.

The following model represents the process variation effect on the I-V of the pixel:

$$I=\beta(\mu+\Delta\mu)(V_{DD}-(V_G+V_{THo}+\Delta V_{TH})^2 \quad (15)$$

where $\mu_0$ is the and $\Delta\mu$ are the nominal and variation of the transistor mobility, $V_{THo}$ and $\Delta V_{TH}$ are the nominal and variation of the effective threshold voltage.

Figure 8:
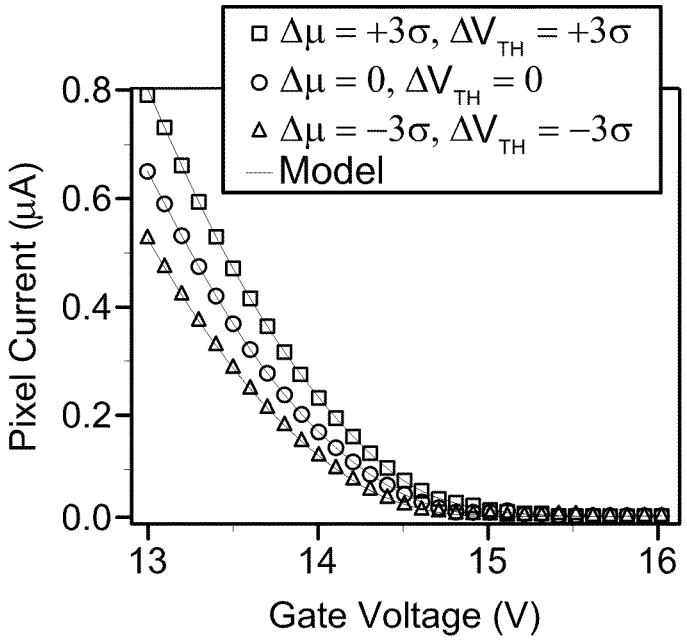
FIG. 8 shows comparisons of SPICE simulations to quadratic models.
Figure 7A:
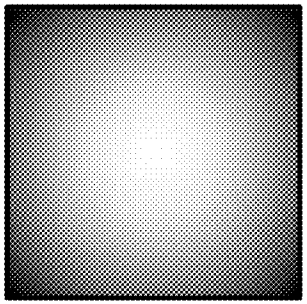
FIGS. 7(*a*)-7(*j*) are patterns representing principal components.
Figure 7B:
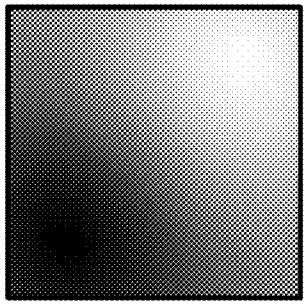
Figure 7C:
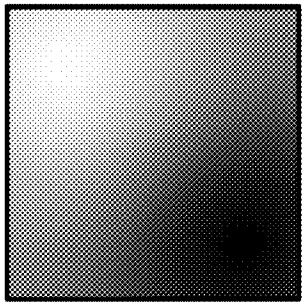
Figure 7D:
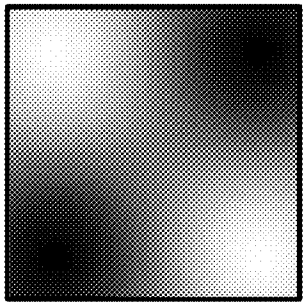
Figure 7E:
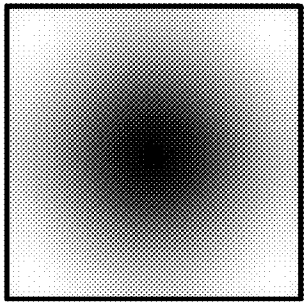
Figure 7F:
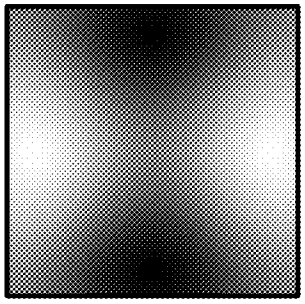
Figure 7G:
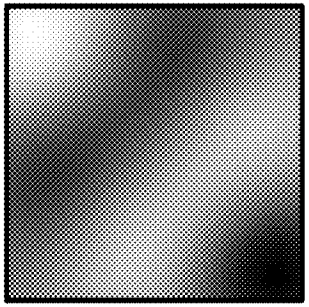
Figure 7H:
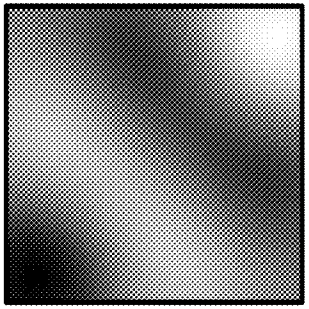
Figure 7I:
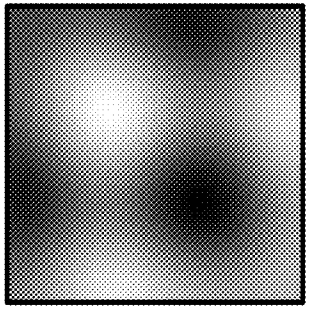
Figure 7J:
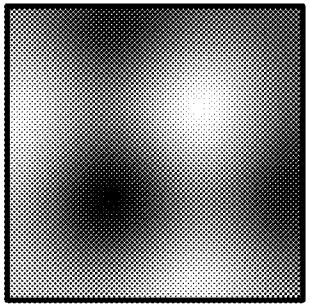

FIG. 8 shows comparisons of SPICE simulations to quadratic models at the nominal and two extreme process corners. The model at the nominal includes the values $\Delta\mu=0$ and $\Delta V_{TH}=0$ for Equation (15). The model at the first process corner includes the values $\Delta\mu=+3\sigma$ and $\Delta V_{TH}=+3\sigma$. The model at the second process corner includes the values $\Delta\mu=-3\sigma$ and $\Delta V_{TH}=-3\sigma$. Using these models, a coefficient of determination, $R^2$, can be calculated to be approximately 0.98 for the gate voltage range of 13-14 V. Therefore, this voltage range can be used as $V_{min}$ and $V_{max}$ values by the extraction unit 320 in the non-uniformity extraction phase discussed below.

Similar to the examples above, the vertical mura and the coefficients of the major principal components of the background non-uniformity of both mobility and the threshold voltage can be extracted by displaying appropriate images on the panel, sensing the total current of the panel, and post-processing of the data.

The following equation represents the total current of a panel of size R×C:

$$I_p = \beta \sum_{i,j=1}^{RC} (\mu_o + \Delta\mu_{ij}) P_{ij}^2 \left(1 + \frac{\Delta V_{TH_{ij}}}{P_{ij}}\right)^2 \tag{16}$$

where $P_{ij}=V_{DD}+V_{TH_O}$ is the drive-in voltage of the pixel at the i-th row and j-th column. For the gate voltage range of 13-14 V, since $$\frac{\Delta V_{TH_{ij}}}{P_{ij}} << 1,$$

the equation is approximated as $$I_p = \beta \sum_{i,j=1}^{R,C} Pij(\mu_o + \Delta\mu_{ij})(P_{ij} + 2\Delta V_{TH_{ij}}) \tag{17}$$

Equation (17) can be used to derive the vertical average and the coefficients of the principal components, all of which are weighted sums of a type of a process parameters.

In this example, the vertical laser scan impact on the mobility is first extracted. The average mobility of each column is computed by displaying two patterns on the column (i.e., as described above using the pattern generator 318 and panel driver 316) and measuring their respective currents (i.e., as described above using the sensor 312 and measurement unit 314). While the rest of panel is programmed by full $V_{DD}$ gate voltage (to turn off the drive TFTs for the rest of the pixels) the column of interest is driven by two different constant voltages, $V_G^{(1)}$ and $V_G^{(2)}$ sequentially. The choice of the voltages can be made in a way that the gate voltage must be set within the range of the I-V model validity. If the measured current of the corresponding patterns are $I_1$ and $I_2$, the average mobility variation of the column j can then be obtained from $$\Delta\mu_j = \frac{\sum_{i=1}^{R} \Delta\mu_{ij}}{R} = \frac{I_2 - \frac{P_2}{P_1} I1 - R\beta\mu_o P2(p_2 - p_1)}{R\beta p_2(p_2 - p_1)} \tag{18}$$

Where $p1=V_{DD}V_{TH_O}-V_G^{(1)}$ and $p2=V_{DD}V_{TH_O}V_G^{(2)}$

After all columns are measured, the background mobility variation (anything except vertical artifacts) can be efficiently extracted by finding the coefficients of the most important principal components. In this example, $W_{max}$ is a principal component and $W_{max}$ is absolute value of the largest element. For computing each principal component factor, four patterns can be displayed sequentially and the panel current can be measured for each. The four patterns provide following gate voltage profile:

$$\begin{aligned} V_{G_{ij}}^{(1)} &= V_{DD} + V_{TH_O} - \left(a - \frac{bW_{ij}}{2}\right)^{\frac{1}{2}} \\ V_{G_{ij}}^{(2)} &= kV_{G_{ij}}^{(1)} \\ V_{G_{ij}}^{(3)} &= V_{DD} + V_{TH_O} - \left(a + \frac{bW_{ij}}{2}\right)^{\frac{1}{2}} \\ V_{G_{ij}}^{(4)} &= kV_{G_{ij}}^{(3)} \end{aligned} \tag{19}$$

where k is an arbitrary constant close to 1 (e.g. 1.1), and $$\begin{aligned} a &= \frac{(V_{DD} + V_{TH_O} - V_{min})^2 + (V_{DD} + V_{TH_O} - V_{max})^2}{2} \\ b &= \frac{(V_{DD} + V_{TH_O} - V_{min})^2 - (V_{DD} + V_{TH_O} - V_{max})^2}{W_{max}} \end{aligned} \tag{20}$$

where $V_{max}$ and $V_{min}$ are maximum and minimum applied gate voltages, for example 14 and 13V as described above. Such values for a and b guarantee that the gate voltage, $V_G$, stays between desired maximum and minimum levels.

If the panel current for these four patterns are measured as $I_1 \ldots I_4$, then the coefficient of the principal component W of the background mobility non-uniformity can be computed by the extraction unit 320 as $$\sum_{i,j=1}^{R,C} W_{ij}(\Delta\mu_{ij} - \Delta\hat{\mu}_i) = \frac{\frac{I_4 - I_{2-k}(I_3 - I_1)}{k^2 - k} - b\beta\mu O \sum_{i,j=1}^{R,C} W_{ij\Delta\mu j}}{b\beta} \tag{21}$$

Therefore, the total number of current measurements (number of image frames to be displayed), required for the extraction of the mobility non-uniformity using the average vertical variation and the top $m_\mu$ principal components, is 2 C+4 $m_\mu$.

Once the mobility variation profile is estimated, the threshold voltage variation can be characterized by decomposing it into vertical and background variation components. The average threshold voltage variation of a column j, can be extracted using one current measurement. In this example, the following gate voltage pattern is applied to the column while the rest of the panel is left off:

$$\begin{aligned} &\text{if } (k=j) V_{G_{ik}} = V_{DD} V_{TH_O}(\mu_o + \Delta\mu_{min}) \\ &\text{if } (k \neq j) V_{G_{ik}} = V_{DD} \end{aligned} \tag{22}$$

Where $$c = 0.5X((V_{DD} + V_{TH_O} - V_{min})(\mu_O + \Delta\mu_{min}) + (V_{DD} + V_{TH_O} - V_{max})(\mu_O + \Delta\mu_{max})) \tag{23}$$

This ensures that the gate voltage at the column of interest remains between the $V_{min}$ and $V_{max}$ limits, so that the condition for the first order approximation model (Equation (17)) of the pixel I-V holds. Therefore, if the measured current is I, the average threshold variation of the column j is $$\Delta\hat{V}_{TH_j} = \frac{\sum_{i=1}^{R}\Delta_{TH_{ij}}}{R} = \frac{I - \beta c^2\sum_{i=1}^{R}\frac{1}{\mu_O + \Delta\mu_{ij}}}{2\beta c R} \tag{24}$$

To extract the coefficients of the major principal components of the background threshold voltage variation, two measurements can be applied per coefficient, as follows:

$$V_{G_{ij}}^{(1)} = V_{DD} + V_{TH_O} - \left(d - \frac{eW_{ij}}{2(\mu_O + \Delta\mu_{ij})}\right) \tag{25}$$

$$V_{G_{ij}}^{(2)} = V_{DD} + V_{TH_O} - \left(d + \frac{eW_{ij}}{2(\mu_O + \Delta\mu_{ij})}\right)$$

Where $$d = \frac{0.5}{\mu_o}x((V_{DD} + V_{TH_O} - V_{min})(\mu_O + \Delta\mu_{min}) + (V_{DD} + V_{TH_O} - V_{max})(\mu_O + \Delta\mu_{max})) \tag{26}$$

$$d = \frac{1}{W_{max}}x((V_{DD} + V_{TH_O} - V_{min})(\mu_O + \Delta\mu_{min}) - (V_{DD} + V_{TH_O} - V_{max})(\mu_O + \Delta\mu_{max}))$$

The full-panel current for the displayed patterns are measured as $I_1$ and $I_2$. The coefficient of the corresponding principal component of the background threshold voltage variation is $$\sum_{i,j=1}^{R,C} W_{ij}\left(\Delta V_{TH_{ij}} - \Delta\hat{V}_{TH_j}\right) = -\sum_{i,j=1}^{R,C} W_{ij}\Delta\hat{V}_{TH_j} + \frac{\frac{I_2 - I_1}{\beta} - \sum_{i,j=1}^{R,C}\left(\left(d + \frac{eW_{ij}}{2(\mu_O + \Delta\mu_{ij})}\right)^2 - \left(d - \frac{eW_{ij}}{2(\mu_O + \Delta\mu_{ij})}\right)^2(\mu_O + \Delta\mu_{\mu ij})\right)}{2e} \tag{27}$$

To estimate the threshold voltage and mobility variation profile, the total number of current measurements is 3 C+4 $m_\mu$+2 $mV_{TH}$, where C is the number of panel columns, $m_\mu$ is the number of principal components used to model mobility variation component other than mura impacts, and $mV_{TH}$ is that of the threshold voltage variation.

In order to remove the small impact of first degree approximation in the Equation (17), the computations of Equations (18), (21), (24), and (27) can be repeated by changing the value of current measurements according to the following equation:

$$I_{new} = I - \beta\sum_{i,j=1}^{R,C}(\mu_O + \Delta\mu_{ij})\Delta V_{TH_{ij}}^2 \tag{28}$$

where $\Delta\mu$ and $\Delta V_{TH}$ are the estimated variation from the last iteration. The subtracted term is equal to the second degree term that has been ignored by applying the first degree approximation.

The pattern generator 318 can include several sets of patterns corresponding to typical display usage. The actual usage of the display can be determined based on the display input. The actual usage can then be matched most closely with one of the typical display usage sets of patterns. Once again, because the patterns that contribute most to the non-uniformity values can be identified, the pattern generator 318 can be configured to generate those patterns first, and the extraction unit 320 can begin solving for, and deriving an accurate approximation of, the non-uniformity values before all of the patterns have been generated and measured.

If no training set is available, the spatial statistics of the ageing profiles can be used to directly construct the covariance matrix of Z. It is also possible to start with an ageing profile extracted using any other method, divide it to batch sizes of, for example 8×8 or 16×16, and use the batches as training sets. The extracted orthogonal transformation using this method can be used to locally extract the ageing (within single batches).

Figure 9:
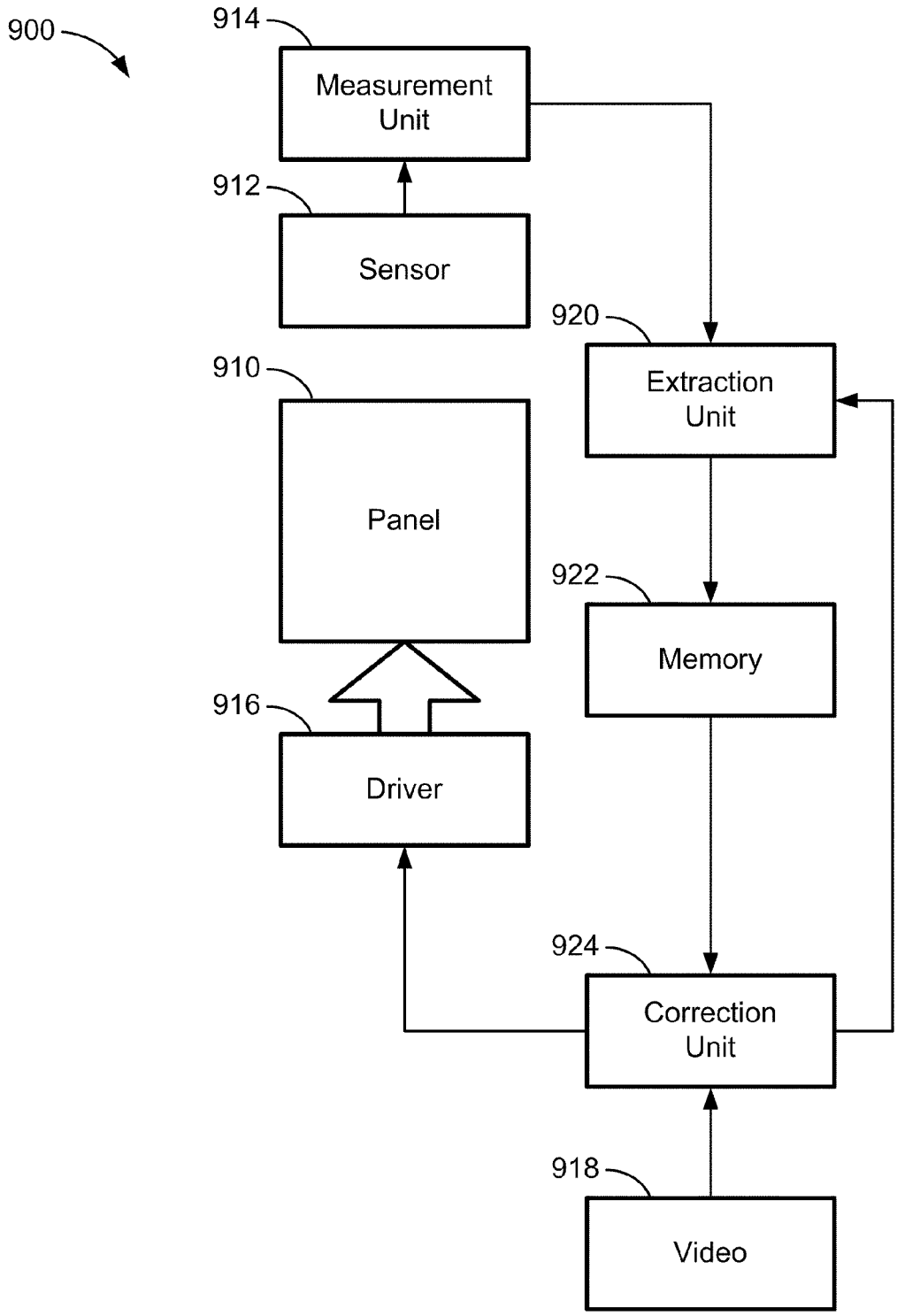
FIG. 9 is a block diagram of a system for measuring and correcting for AMOLED display non-uniformity by extracting principal components based on a video signal.

Principal components can be calculated based on a predefined ageing pattern or based on a moving averageing of the display input. FIG. 9 shows a system 900 that can be used to extract principal components for a display panel 910 based on a video signal 918. A driver 916 drives the display panel 910 according to the video signal 918. Similar to the system of FIG. 3, a sensor 912 senses a property (e.g., power supply current) of the panel 910 responsive to the driver 916. A measurement unit 914 converts the sensor 912 output into numerical measurement values, which are passed to an extraction unit 920, which evaluates the measurements. Status values calculated by the extraction unit 920 can be stored in a memory 922 for use by a correction unit 924. The video signal 918 can be periodically or continuously monitored to determine display usage. A dictionary of principal components can also be constructed based on the monitored display usage.

Figure 12B:
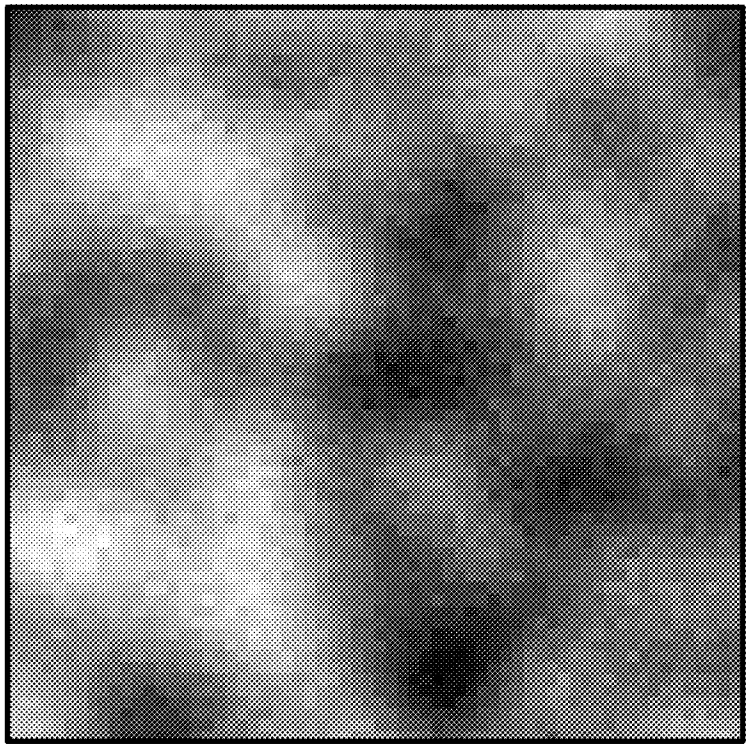
FIG. 12(*a*) is a picture of actual panel ageing and FIG. 12(*b*) is a picture of an estimate of the ageing using principal component analysis.
Figure 12A:
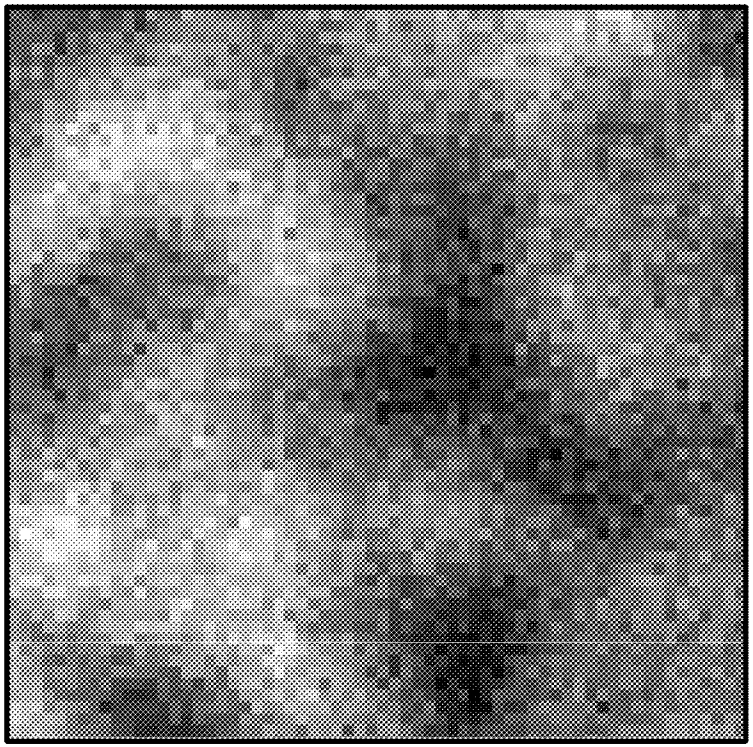

FIG. 12(*a*) shows an example of actual panel ageing of a 200 by 200 pixel panel. FIG. 12(*b*) shows an estimate of the panel ageing using principal component analysis after 200 measurements. As can be seen, a close estimate of the ageing of the display can be obtained with significantly fewer measurements than measuring each pixel individually.

5. Video Signal as Transformation Vector

Figure 10:
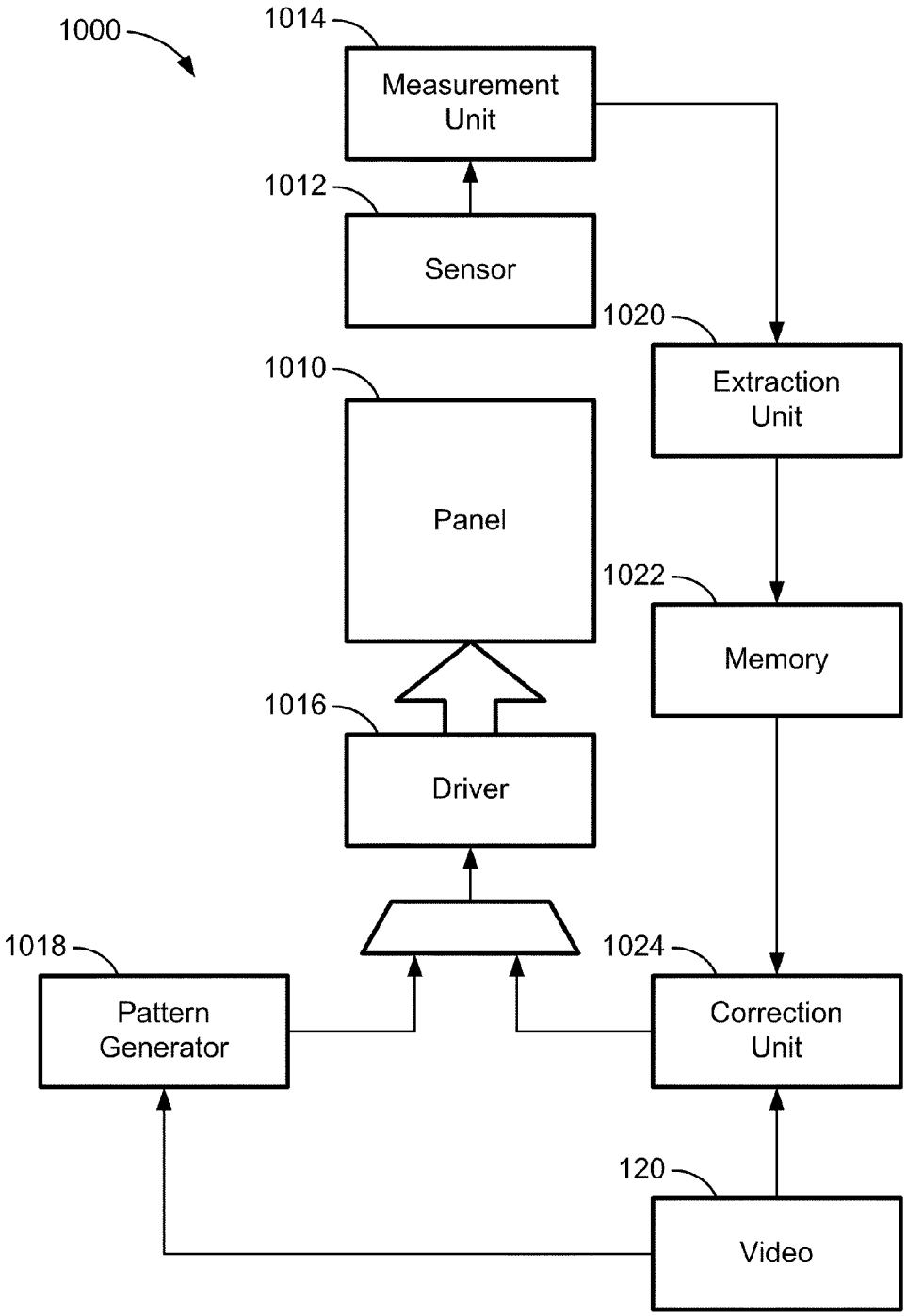
FIG. 10 is a block diagram of a system for measuring and correcting for AMOLED display non-uniformity using a video signal as a transformation vector.

A video signal can also be used as a transformation vector. For example, each frame of a video signal can be written as a linear combination of either cosine or other waveform transformation vectors. As a result, the video can be used to extract the ageing (or pixel parameters) of the display. FIG. 10 illustrates a system 1000 for measuring and correcting for panel non-uniformity using a video signal as a transformation vector. The input video signal 120 is received by a pattern generator 1018, which converts the frames of the video signal into the form of a DCT and/or other waveform transformation. Alternatively, the input video signal 120 can be received as a series of frames in the form of a DCT and/or other waveform transformation. A driver 1016 drives the display 1010 in accordance with the patterns, and a sensor 1012 senses the results for each frame. A measurement unit 1014 measures the output of the sensor 1012 and sends the measurements to an extraction unit 1020. The extraction unit 1020 constructs a matrix of ageing values using the inverse of the transformations used to construct the patterns. The ageing values can be stored in a memory 1022, and used by a correction unit 1024 to make compensating adjustments to the input video signal 120 before it is displayed.

C. Compressive Sensing of Ageing and Non-Uniformity Profiles

Calculating a transformation vector M directly by applying proper images, reading their currents, and extracting coefficients using Equations (5, 9, and 11) is a very fast technique. However, since the energy compaction is not perfect, it is always possible that some of the measurements lead to very small transformed M elements, while some of the significant ones may be neglected. This issue degrades the accuracy of the extracted ageing profile unless the number of measurements increases significantly to compensate for the neglected transformation coefficients. If a priori knowledge on the significant transformation coefficients is available, it can be used to select which elements of M should be calculated and which should be ignored in order to obtain a high quality profile with a low number of measurements.

The quality of extracted ageing values can also be improved, while keeping the measurement numbers small, by using images of random pixels and applying basic pursuit optimization to extract the original profile. This process is similar to compressive sensing.

For example, if N images are constructed each with pixels of randomly set gray-scale, based on a uniform, Bernoulli, Gaussian, or video-content-dependent images, the ageing values can be optimized according to the following equation:

$$\min \sum_{i=1}^{rc} [M(i)]$$

Subject to:

$$\text{for } i = [1, \ldots, N] \tag{29}$$

$$I_j = \beta_2 \sum_{i=1}^{rc} ((V_G(i) - V_{OS})^a - a(V_G(i) - V_{OS})^{a-1} A(i))$$

$$A = W^T x M$$

Here $V_G(i)$ is the gate voltage of the random pixel i at j-th image, and $W^T$ the transpose of the transformation dictionary (e.g. DCT, Wavelet, PCA, etc.), and $I_j$ the current consumption of the j-th image. A linear programming, iterative orthogonal matching pursuit, tree matching pursuit, or any other approach can be used to solve this basic pursuit optimization problem.

In Equation (29), the approximated first-order Taylor current equation is used to maintain the linearity of the optimization constraint. After finding an initial estimate of the ageing, A, it can also be used to provide a closer linear approximation and by re-iterating the optimization algorithm it converges to the actual ageing profile. The new constraint used in the subsequent iterations of Equation (29) is:

$$I_j = \beta_2 \sum_{i=1}^{rc} \left( (V_G(i) - V_{OS})^a \left( \left(1 - \frac{A_{old}(i)}{V_G(i) - V_{OS}}\right)^a + a\frac{A_{old}(i)}{V_G(i) - V_{OS}} - a\frac{A(i)}{V_G(i) - V_{OS}} \right) \right) \tag{30}$$

Finally, to decompose the estimated ageing between the two components of OLED ageing and TFT ageing, the supply voltage can be pulled down for a new set of measurements. The new measurements can be optimized according to the following equation:

$$\min \sum_{i=1}^{rc} [M(i)]$$

Subject to:

$$\text{For } i = [1, \ldots, N] \tag{31}$$

$$I_j = \beta_1 \sum_{i=1}^{rc} (V_G(i) - V_{ot} - Ai + V_{oa}(i) - (y + \theta V_G(i))V_{oa}(i))$$

$$V_{oa} = W^T x M$$

As can be seen, the status (e.g., ageing) of an OLED display can be evaluated, and an accurate approximation of the ageing can be obtained, using a single sensor or small number of sensors, and a reduced sequence of input patterns. Less hardware can be used to measure display status, reducing cost, and fewer computations can be used to evaluate the measurements, reducing processing time.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A method of evaluating OLED display pixel status and compensating for degradation of individual pixels within the display, said method comprising:

generating a sequence of patterns representing pixel values for a display panel, wherein the sequence of patterns is a subset of a full sequence of patterns;

driving the OLED panel with the sequence of patterns;

sensing a sequence of values representing the responses of the panel to the respective ones of the sequence of patterns, said sequence of values including at least one of power supply current and brightness of the display panel;

using a non-uniformity model based on said sensed sequence of values representing said responses of the panel to the respective ones of the sequence of patterns, mathematically deriving from the sensed sequence of values a matrix of status values representing at least one of the ageing and non-uniformity of each of the individual pixels in the panel;

storing the matrix of status values in a memory; and using said status values to compensate individual pixels in the display panel for at least one of ageing and non-uniformity.

2. The method of claim 1, further comprising applying to the panel a correction signal corresponding to the matrix of status values.

3. The method of claim 1, wherein the generating uses at least one of a discrete cosine transformation and a wavelet transformation to generate at least one of the patterns, and wherein the deriving uses an inverse of the at least one transformation.

4. The method of claim 3, further comprising:

discarding from the sequence of patterns a pattern that contributes less than a threshold amount to the matrix of status values; and repeating the generating, driving, sensing, deriving, and storing steps.

5. The method of claim 4, further comprising:

reintroducing the discarded pattern to the sequence of patterns; and repeating the generating, driving, sensing, deriving, and storing steps.

6. The method of claim 1, wherein the generating comprises generating at least one pattern based on a principal component analysis.

7. The method of claim 6, wherein the principal component analysis comprises generating a principal component through at least one of a predefined non-uniformity pattern and a moving averaging of an input to the OLED display.

8. The method of claim 1, wherein driving the OLED panel comprises operating the pixel driving transistors in a first operating position and a second operating position;

the sequence of patterns includes patterns corresponding to each of the first operating position and the second operating position; and the matrix of status values includes values corresponding to two discrete display characteristics.

9. The method of claim 8, wherein the first operating position is a linear region and the second operating position is a saturation region.

10. The method of claim 8, wherein the first operating position and the second operating position are offset by an offset voltage.

11. An apparatus for evaluating OLED display status, comprising:

a pattern generator configured to generate a sequence of pixel patterns, wherein the sequence of patterns is a subset of a full sequence of patterns;

a pixel driver coupled to the pattern generator configured to drive a display panel with the sequence of pixel patterns generated by the pattern generator;

a sensor configured to sense panel response values corresponding to a pattern generated by the pattern generator, said response values including at least one of power supply current and brightness of the display panel;

an extraction module coupled to the sensor configured to mathematically extract, using a non-uniformity model based on said sensed panel response value corresponding to a pattern generated by the pattern generator, a set of status values corresponding to at least one of the ageing and non-uniformity of each of the individual pixels of the panel from the panel response values;

a memory configured to store the set of status values; and using said status values to compensate individual pixels in the display panel for at least one of ageing and non-uniformity.

12. The apparatus of claim 11, further comprising a correction module coupled to the pixel driver configured to generate a set of correction signals corresponding to the status values.

13. The apparatus of claim 11, wherein the sensor is one of a current sensor configured to sense an OLED panel $V_{DD}$ current, an optical sensor configured to sense a light intensity of the OLED display, or a thermal sensor configured to sense a thermal value of the OLED display.

14. The apparatus of claim 11, wherein a pattern is generated using at least one of a discrete cosine transformation and a wavelet transformation.

15. The apparatus of claim 11, wherein the pattern generator is configured to discard a pattern that contributes less than a threshold amount to the matrix of status values.

16. The apparatus of claim 11, wherein the pattern generator is configured to generate at least one pattern based on a principal component analysis.

17. The apparatus of claim 16, wherein the pattern generator is configured to generate at the least one pattern through at least one of a predefined status pattern and a moving averaging of an input to the OLED display.

18. The apparatus of claim 11, wherein the pixel driver is further configured to alternately drive the pixel driving transistors in a first operating position and a second operating position;

the sequence of patterns includes patterns corresponding to each of the first operating position and the second operating position; and the extraction module is further configured to extract status values representative of two discrete display characteristics.

19. The apparatus of claim 18, wherein the first operating position and the second operating position are offset by an offset voltage.

20. The apparatus of claim 18, wherein the two discrete display characteristics are driving transistor ageing and OLED pixel ageing.

* * * * *

UNITED STATES PATENT AND TRADEMARK OFFICE

CERTIFICATE OF CORRECTION

PATENT NO. : 8,994,617 B2
APPLICATION NO. : 13/050006
DATED : March 31, 2015
INVENTOR(S) : Gholamreza Chaji et al.

It is certified that error appears in the above-identified patent and that said Letters Patent is hereby corrected as shown below:

On the Title Page, Item (75), for inventor Arokia Nathan, please delete the country "(CA)" and insert -- (GB) --, therefor.

Signed and Sealed this
Twenty-first Day of July, 2015

Michelle K. Lee

Michelle K. Lee
*Director of the United States Patent and Trademark Office*